US007397448B2

(12) United States Patent
Stevenson et al.

(10) Patent No.: US 7,397,448 B2
(45) Date of Patent: Jul. 8, 2008

(54) CIRCUITS INCLUDING PARALLEL CONDUCTION PATHS AND METHODS OF OPERATING AN ELECTRONIC DEVICE INCLUDING PARALLEL CONDUCTION PATHS

(75) Inventors: Matthew Stevenson, Santa Maria, CA (US); Gang Yu, Santa Barbara, CA (US); Weixiao Zhang, Goleta, CA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 635 days.

(21) Appl. No.: 10/892,992

(22) Filed: Jul. 16, 2004

(65) Prior Publication Data

US 2006/0012587 A1 Jan. 19, 2006

(51) Int. Cl.
*G09G 3/30* (2006.01)

(52) U.S. Cl. ..... 345/76; 345/44; 315/169.3

(58) Field of Classification Search ..... 345/76, 345/204, 77, 78, 79, 80, 44, 45, 46; 315/169.3
See application file for complete search history.

(56) References Cited

U.S. PATENT DOCUMENTS 6,734,636 B2 5/2004 Sanford et al.
2002/0195968 A1 12/2002 Sanford et al.
2003/0052614 A1 3/2003 Howard
2003/0094616 A1 5/2003 Andry et al.
2003/0095087 A1 5/2003 Libsch et al.
2003/0107565 A1 6/2003 Libsch et al.
2004/0061671 A1 4/2004 Kawasaki et al.
2004/0174349 A1 9/2004 Libsch et al.
2006/0097965 A1 * 5/2006 Deane et al. ..... 345/76

* cited by examiner

*Primary Examiner*—Sumati Lefkowitz
*Assistant Examiner*—Seokyun Moon
(74) *Attorney, Agent, or Firm*—John H. Lamming

(57) ABSTRACT

In one embodiment, a circuit for driving an electronic component includes a first conduction path and a second conduction path connected in parallel. Each of the first and second conduction paths includes a field-effect transistor. The first field-effect transistor lies along the first conduction path, and the second field-effect transistor lies along the second conduction path. The circuit can be used in an electronic device that includes a radiation-emitting electronic component or a radiation-responsive electronic component. During a first time period, current flows through the first conduction path and the first electronic component while a second conduction path of a driving unit is off. During a second time period, current flows through the second conduction path and the first electronic component while the first conduction path of the driving unit is off.

15 Claims, 13 Drawing Sheets

CIRCUITS INCLUDING PARALLEL CONDUCTION PATHS AND METHODS OF OPERATING AN ELECTRONIC DEVICE INCLUDING PARALLEL CONDUCTION PATHS

BACKGROUND OF THE INVENTION

1. Field of the Invention

This invention relates in general to circuits and methods of operating electronic devices, and more particularly, to circuits including parallel conduction paths and methods of operating electronic devices including parallel conduction paths.

2. Description of the Related Art

Organic electronic devices have attracted considerable attention since the early 1990's. Examples of organic electronic devices include Organic Light-Emitting Diodes ("OLEDs"), which include Polymer Light-Emitting Diodes ("PLEDs") and Small Molecule Organic Light-Emitting Diodes ("SMOLEDs"). Display devices, including OLED displays, have played an important role in modern human life. As computing, telecommunications, home entertainment, and networking technologies converge, the display unit will become more important.

In the display area, there are many kinds of technologies including cathode ray tube ("CRT"), liquid crystal display ("LCD"), inorganic LED displays, and so on. LCD and inorganic LED displays may include transistors within pixel circuits. Metal-insulator-semiconductor field-effect transistors ("MISFETs") may be susceptible to changes in threshold voltage due to charge carriers that become trapped within a gate dielectric layer. However, in the case of LCD and inorganic LED displays, the transistors are on for relatively short amounts of time, and therefore, changes in threshold voltages are not a significant problem in LCD and inorganic LED displays.

OLED technologies have great potential advantages over other display technologies, especially in larger size displays. For example, as display size increases, LCD technology has issues related to the backlight and power consumption. However, OLED material lifetime is a concern. Organic active layers, when used in radiation-emitting electronic components, have a finite lifetime. After a long time of driving a stationary image, inhomogeneity and decay of emission intensity can occur due to different driving (stress) conditions at the organic electronic level.

An anti-degradation mechanism can be used to extend the lifetime of an OLED display as the OLED material degrades. FIG. 1 includes a circuit diagram of a pixel circuit 100 (or a sub-pixel circuit) for a conventional active-matrix ("AM") display. A select unit 102 is configured to receive signals from a select line, SL, and a data line, DL. A select signal on SL activates the select unit to pass a data signal (from DL) to a data holder unit 104 and a driving unit 106. The driving unit 106 can regulate the current flowing to the electronic component 108, which can be a radiation-emitting electronic component, and more particularly, an OLED. To reduce the effects of the use or aging of an organic active layer, an optional anti-degradation unit 110 can be used. The anti-degradation unit 110 is coupled to the data image holder 104 and the driving unit 106. The anti-degradation unit 110 can be used to reduce the charge of a capacitive electronic component within the data holder unit 104.

The anti-degradation unit does not address the threshold voltage shifts seen with MISFETs. Unlike MISFETs in LCD or inorganic LED displays, the MISFET(s) within the driving unit 106 are on for substantially longer periods of time. For example, in an LCD display, a MISFET used within the drive circuit is on for approximately 0.1% of the operational time of the display, whereas in an organic electronic device, a MISFET within the driving unit 106 can be on for substantially all the operational time of the device. With the MISFET on almost all the time, significant amounts of charge carriers can become trapped within the MISFET's gate dielectric layer and cause the threshold voltage of the transistor to drift.

SUMMARY OF THE INVENTION

In one embodiment, a circuit for driving an electronic component includes a first conduction path. The first conduction path includes a first field-effect transistor comprising a gate electrode, a first source/drain region, and a second source/drain region. The circuit also includes a second conduction path. The second conduction path includes a second field-effect transistor comprising a gate electrode, a first source/drain region, and a second source/drain region. The first source/drain region of the first field-effect transistor and the second source/drain region of the first field-effect transistor lie along the first conduction path. The first source/drain region of the second field-effect transistor and the second source/drain region of the second field-effect transistor lie along the second conduction path. The first and second conduction paths are connected in parallel.

In another embodiment, a method is used for operating an electronic device. The electronic device includes a first electronic component, wherein the first electronic component is a radiation-emitting electronic component or a radiation-responsive electronic component. A first terminal of the first electronic component is connected to first terminals of at least two parallel conduction paths within a driving unit, including a first conduction path and a second conduction path. The method includes, during a first time period, activating a first conduction path within the driving unit so that current flows through the first conduction path and the first electronic component while a second conduction path of the driving unit is off. The method also includes, during a second time period, activating the second conduction path within the driving unit so that current flows through the second conduction path and the first electronic component while the first conduction path of the driving unit is off.

In yet another embodiment, a method is used for operating an electronic device. The electronic device includes an array of first electronic components. Each of the first electronic components is a radiation-emitting electronic component or a radiation-responsive electronic component. For each first electronic component, a first terminal of the first electronic component is connected to first terminals of at least two parallel conduction paths within a driving unit, including a first conduction path and a second conduction path. The first conduction path includes a first field-effect transistor including a first source/drain region, a second source/drain region, and a gate electrode. The first and second source/drain regions of the first field-effect transistor are connected to the first conduction path. The second conduction path includes a second field-effect transistor including a first source/drain region, a second source/drain region, and a gate electrode. The first and second source/drain regions of the second field-effect transistor are connected to the second conduction path. The method includes collecting first data regarding first signals sent to the gate electrodes of the first field-effect transistors during a first time period, wherein the first signals correspond to a first image. The method also includes determining second values of second signals that are to be sent to the gate electrodes of the first field-effect transistors during a second time period, wherein the second signals correspond to first threshold voltage recovery signals.

The foregoing general description and the following detailed description are exemplary and explanatory only and are not restrictive of the invention, as defined in the appended claims.

BRIEF DESCRIPTION OF THE DRAWINGS

The invention is illustrated by way of example and not limitation in the accompanying figures.

Figure 1:
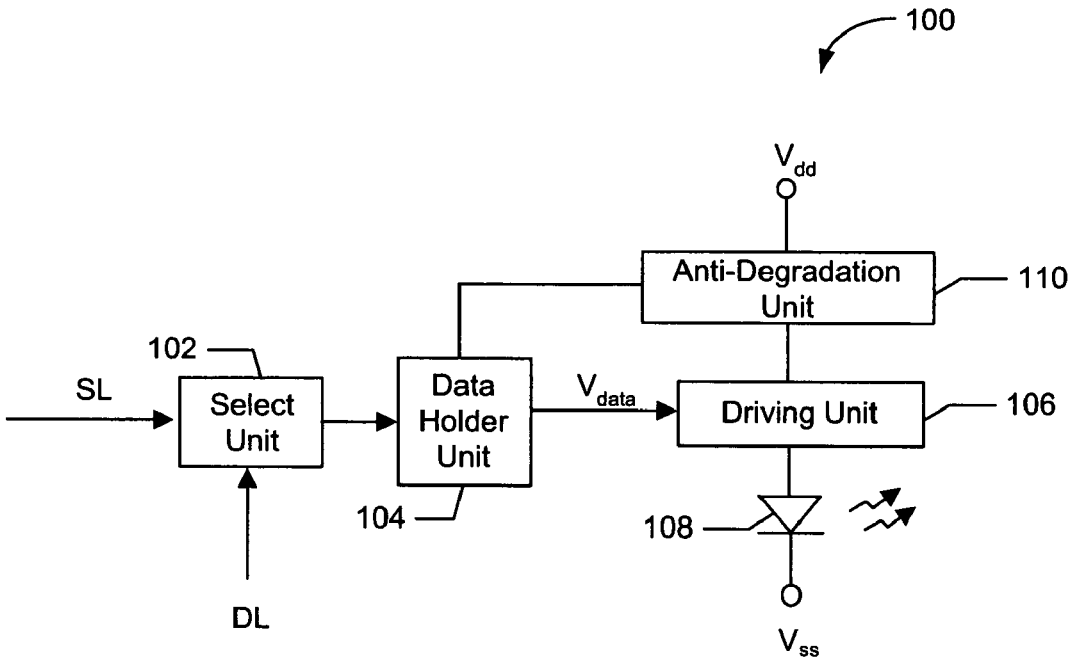
FIG. 1 (Prior Art)
FIG. 1 includes a block diagram of a conventional pixel driver circuit and radiation-emitting electronic component. (Prior art).

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

In one embodiment, a circuit for driving an electronic component includes a first conduction path. The first conduction path includes a first field-effect transistor comprising a gate electrode, a first source/drain region, and a second source/drain region. The circuit also includes a second conduction path. The second conduction path includes a second field-effect transistor comprising a gate electrode, a first source/drain region, and a second source/drain region. The first source/drain region of the first field-effect transistor and the second source/drain region of the first field-effect transistor lie along the first conduction path. The first source/drain region of the second field-effect transistor and the second source/drain region of the second field-effect transistor lie along the second conduction path. The first and second conduction paths are connected in parallel.

In a more specific embodiment, each of the first and second field-effect transistors further includes a gate dielectric layer. The first source/drain regions of the first and second field-effect transistors are connected to each other. The second source/drain regions of the first and second field-effect transistors are connected to each other. The gate electrode of the first field-effect transistor is coupled to a first control line. The gate electrode of the second field-effect transistor is coupled to a second control line.

In still a more specific embodiment, the circuit further includes a first capacitive electronic component and a second capacitive electronic component. First electrodes of the first capacitive electronic component and the second capacitive electronic component are coupled to the first source/drain regions of the first field-effect transistor and the second field-effect transistor. A second electrode of the first capacitive electronic component is connected to the gate electrode of the first field-effect transistor. A second electrode of the second capacitive electronic component is connected to the gate electrode of the second field-effect transistor.

In still another embodiment, the circuit further includes a first data holder unit and a second data holder unit. First terminals of the first data holder unit and the second data holder unit are coupled to the first source/drain regions of the first field-effect transistor and the second field-effect transistor. A second terminal of the first data holder unit is connected to the gate electrode of the first field-effect transistor. A second terminal of the second data holder unit is connected to the gate electrode of the second field-effect transistor.

In still a further embodiment, an electronic device includes any of the previously described circuits and an electronic component. The electronic component includes a first electrode and a second electrode. The first electrode of the electronic component is connected to the second source/drain regions of the first and second field-effect transistors. The second electrode of the electronic component is connected to a power supply line.

In one embodiment, a method is used for operating an electronic device. The electronic device includes a first electronic component, wherein the first electronic component is a radiation-emitting electronic component or a radiation-responsive electronic component. A first terminal of the first electronic component is connected to first terminals of at least two parallel conduction paths within a driving unit, including a first conduction path and a second conduction path. The method includes, during a first time period, activating a first conduction path within the driving unit so that current flows through the first conduction path and the first electronic component while a second conduction path of the driving unit is off. The method also includes, during a second time period, activating the second conduction path within the driving unit so that current flows through the second conduction path and the first electronic component while the first conduction path of the driving unit is off.

In another embodiment, if the first electronic component is a radiation-emitting electronic component, the first electronic component emits radiation during the first and second time periods. If the first electronic component is a radiation-responsive electronic component, the first electronic component responds to radiation during the first and second time periods.

In still another embodiment, the first conduction path includes a first field-effect transistor including a first source/drain region, a second source/drain region, a gate electrode, and a gate dielectric layer. The first and second source/drain regions of the first field-effect transistor are connected to the first conduction path. The second conduction path includes a second field-effect transistor including a first source/drain region, a second source/drain region, a gate electrode, and a gate dielectric layer. The first and second source/drain regions of the second field-effect transistor are connected to the second conduction path.

In a more specific embodiment, the first source/drain regions of the first and second field-effect transistors are connected to each other. The second source/drain regions of the first and second field-effect transistors are connected to each other.

In another specific embodiment, each of the first and second field-effect transistors includes a channel region. The channel region was formed as amorphous silicon (a-Si), low-temperature polysilicon (LTPS), continuous grain silicon (CGS), or any combination thereof.

In yet another embodiment, the electronic device further includes a first data holder unit including a first terminal and a second terminal. The first terminal of the first data holder unit is coupled to the second source/drain region of the first field-effect transistor. The second terminal of the first data holder unit is connected to the gate electrode of the first field-effect transistor. The electronic device further includes a second data holder unit including a first terminal and a second terminal. The first terminal of the second data holder unit is coupled to the second source/drain region of the second field-effect transistor. The second terminal of the second data holder unit is connected to the gate electrode of the second field-effect transistor.

In yet another specific embodiment, during the first time period, the first data holder unit holds a first signal corresponding to a first image, and the second data holder unit holds a second signal corresponding to a first threshold voltage recovery signal. During the second time period, the first data holder unit holds a third signal corresponding to a second threshold voltage recovery signal, and the second data holder unit holds a fourth signal corresponding to a second image.

In one embodiment, a method is used for operating an electronic device. The electronic device includes an array of first electronic components. Each of the first electronic components is a radiation-emitting electronic component or a radiation-responsive electronic component. For each first electronic component, a first terminal of the first electronic component is connected to first terminals of at least two parallel conduction paths within a driving unit, including a first conduction path and a second conduction path. The first conduction path includes a first field-effect transistor including a first source/drain region, a second source/drain region, and a gate electrode. The first and second source/drain regions of the first field-effect transistor are connected to the first conduction path. The second conduction path includes a second field-effect transistor including a first source/drain region, a second source/drain region, and a gate electrode. The first and second source/drain regions of the second field-effect transistor are connected to the second conduction path. The method includes collecting first data regarding first signals sent to the gate electrodes of the first field-effect transistors during a first time period, wherein the first signals correspond to a first image. The method also includes determining second values of second signals that are to be sent to the gate electrodes of the first field-effect transistors during a second time period, wherein the second signals correspond to first threshold voltage recovery signals.

In another embodiment, the first signals have an opposite polarity compared to the second signals. A reference voltage for determining polarity is a reference voltage representative of voltages of the first source/drain regions of the first field-effect transistors or the second source/drain regions of the first field-effect transistors during the first time period.

In still another embodiment, the method further includes accessing a length of the first time period. The method still further includes determining first voltage-time products. For each first field-effect transistor, each of the first time-voltage products is the length of the first time period times a first voltage difference for one of the first field-effect transistors, and the first voltage difference for the each first field-effect transistor is a voltage on the gate electrode of the first field-effect transistor minus a voltage on the first source/drain region of the first field-effect transistor, the second source/drain region of the first field-effect transistor, or both. The method yet further includes accessing a length of the second time period.

In a more specific embodiment, determining the second values of the second signals includes multiplying the first voltage-time products times −1 to give second voltage-time product. Determining the second values of the second signals further includes dividing the second voltage-time products by the length of the second time period to obtain quotients. Determining the second values of the second signals still further includes adding the quotients to a reference voltage to obtain the values of the second signals.

In yet another specific embodiment, the electronic device includes a driving unit including the first and second field-effect transistors. The driving unit further includes a first data holder unit including a first terminal and a second terminal. The first field-effect transistor further includes a gate dielectric layer. The first terminal of the first data holder unit is connected to the gate electrode of the first field-effect transistor. The second terminal of the first data holder unit is coupled to the second source/drain region of the first field-effect transistor. The driving unit still further includes a second data holder unit including a first terminal and a second terminal. The second field-effect transistor further includes a gate dielectric layer. The first terminal of the second data holder unit is connected to the gate electrode of the second field-effect transistor. The second terminal of the second data holder unit is coupled to the second source/drain region of the second field-effect transistor.

In any of the previously described embodiment, each of the first and second field-effect transistors includes a gate dielectric layer, a channel region, or both. The channel region was formed as amorphous silicon (a-Si), low-temperature polysilicon (LTPS), continuous grain silicon (CGS), or any combination thereof. Each the first electronic components includes an organic electronic device including an organic active layer, is a radiation-emitting electronic components, or both.

The detailed description first addresses Definitions and Clarification of Terms followed by Threshold Voltage and Trapped Charge, Exemplary Circuits, Exemplary Methodologies, Other Embodiments, and finally, Advantages.

1. Definitions and Clarification of Terms

Before addressing details of embodiments described below, some terms are defined or clarified. The term "accessing," when referring to data, is intended to mean reading or otherwise obtaining such data from memory or other data source.

The term "activating," when referring to an electronic component or circuit, is intended to mean providing proper signal (s) to the electronic component or circuit so that electronic component or circuit is at least partially on or is performing one of its principal functions.

The term "active" when referring to a layer or material is intended to mean a layer or material that has electronic or electro-radiative properties. An active layer material may emit radiation or exhibit a change in concentration of electron-hole pairs when receiving radiation.

The term "amorphous silicon" ("a-Si") is intended to mean one or more layers of silicon having no discernible crystalline structure.

The terms "array," "peripheral circuitry," and "remote circuitry" are intended to mean different areas or components of an electronic device. For example, an array may include a number of pixels, cells, or other structures within an orderly arrangement (usually designated by columns and rows). The pixels, cells, or other structures within the array may be controlled locally by peripheral circuitry, which may lie on the same substrate as the array but outside the array itself. Remote circuitry typically lies away from the peripheral circuitry and can send signals to or receive signals from the array (typically via the peripheral circuitry). The remote circuitry may also perform functions unrelated to the array. The remote circuitry may or may not reside on the substrate having the array.

The term "channel region" is intended to mean a region lying between source/drain regions of a field-effect transistor, whose biasing, via a gate electrode of the field-effect transistor, affects the flow of carriers, or lack thereof, between the source/drain regions.

The term "charge carriers," with respect to an electronic component or circuit, is intended to mean the smallest unit of charge. Charge carriers can include n-type charge carriers (e.g., electrons or negatively charged ions), p-type charge carriers (e.g., holes or positively charged ions), or any combination thereof The term "circuit" is intended to mean a collection of electronic components that collectively, when properly connected and supplied with the proper potential(s), performs a function. A TFT driver circuit for an organic electronic component is an example of a circuit.

The term "conduction path" is intended to mean a portion of a circuit through which a substantially constant current flows when (1) a direct current power is applied to the such portion and (2) all switches, transistors, etc. in such portion are on. A conduction path can include a wire by itself or a wire in combination with one or more diode, resistor, transistor, or the like. For a transistor, current-carrying electrodes of the transistor are connected to the conductor path. A conduction path does not include a capacitor or an inductor because the current flowing through the conduction path significantly varies with time when a direct current signal is used.

The term "connected," with respect to electronic components or portions thereof, is intended to mean that two or more electronic components or portions do not have any intervening electronic component lying between them. Parasitic resistance (e.g., line loss), parasitic capacitance, or both are not considered electronic components for the purposes of this definition. In one embodiment, electronic components are connected when they are electrically shorted to one another and lie at substantially the same voltage. Note that electronic components can be connected together using fiber optic lines to allow optical signals to be transmitted between such electronic components.

The term "continuous grain silicon ("CGS") is intended to mean a type of polysilicon in which individual crystals are oriented in a direction substantially parallel to the channel length of a field-effect transistor. The oriented crystals reduce the frequency with which a charge encounters a grain boundary, resulting in an overall higher mobility of the channel region compared to a randomly oriented polysilicon channel.

The term "coupled" is intended to mean a connection, linking, or association of two or more electronic components, circuits, or systems in such a way that a signal (e.g., current, voltage, or optical signal) may be transferred from one to another. Non-limiting examples of "coupled" can include direct connections between electronic components, circuits or electronic components with switch(es) (e.g., transistor(s)) connected between them, or the like.

The term "data holder unit" is intended to mean an electronic component or collection of electronic components configured to retain data on at least a temporary basis. An image holder unit is an example of a data holder unit, wherein the data corresponds to at least a portion of an image.

The term "data driver," "data driver circuit," or "driving unit" is intended to mean a circuit used to provide signals of the proper amplitude or strength to one or more electronic components coupled to receive a signal from such circuit. For example, a data driver may provide signals to organic electronic components within an array.

The term "de-trap," with respect to charge carriers, is intended to mean that the removal of at least one trapped charge carrier from within a layer, member, structure, or combination thereof, when an electrical field of a proper polarity and sufficient strength is applied to such layer, member, structure, or combination thereof for a sufficient length of time.

The term "electronic component" is intended to mean a lowest level unit of a circuit that performs an electrical or optical function. An electronic component may include a transistor, a diode, a resistor, a capacitor, an inductor, or the like. An electronic component does not include parasitic resistance (e.g., resistance of a wire) or parasitic capacitance (e.g., capacitive coupling between two conductors connected to different electronic components where a capacitor between the conductors is unintended or incidental).

The term "electronic device" is intended to mean a collection of circuits, organic electronic components, or combinations thereof that collectively, when properly connected and supplied with the proper potential(s), performs a function. An electronic device may include or be part of a system. Examples of electronic devices include displays, sensor arrays, computer systems, avionics, automobiles, cellular phones, and many other consumer and industrial electronic products.

The term "emit," when referring to a radiation-emitting electronic component, is intended to mean the emanation of radiation at a targeted wavelength or spectrum of wavelengths from such radiation-emitting electronic component.

The term "field-effect transistor" is intended to mean a transistor, whose current carrying characteristics are affected by a potential on a gate electrode. Field-effect transistors include junction field-effect transistors (JFETs) and metal-insulator-semiconductor field-effect transistors (MISFETs), including metal-oxide-semiconductor field-effect transistors (MOSFETs), metal-nitride-oxide-semiconductor (MNOS) field-effect transistors, and combinations thereof. A field-effect transistor can be n-channel (n-type carriers flowing within the channel region) or p-channel (p-type carriers flowing within the channel region). A field-effect transistor may be an enhancement-mode transistor (channel region having a different conductivity type compared to the source/drain regions) or depletion-mode transistor (channel and source/drain regions have the same conductivity type).

The term "frame time" is intended to mean a time period over which an image is presented by a display. The frame time can be thought of as how long a "snapshot" of an image is displayed before a new image is displayed. In one embodiment, the frame time can be 1/60 second.

The term "gate dielectric layer" is intended to mean one or more layers of one or more dielectric materials lying between a gate electrode and a channel region of a field-effect transistor.

The term "gate electrode" is intended to mean an electrode of a field-effect transistor that controls the flow of carriers, or lack thereof, between source/drain regions of the field-effect transistor via a voltage on the electrode.

The term "low-temperature polysilicon" ("LTPS") is intended to mean one or more layers of polysilicon deposited at a temperature no greater than 550° C. One example of a process for forming LTPS is Sequential Lateral Solidification ("SLS"), in which a modified excimer laser crystallization ("ELC") process is used to form oriented grains of larger sizes, resulting in higher mobilities for charge carriers, when compared to conventional ELC techniques for forming LTPS.

The terms "on" and "off," with respect to a transistor, switch, conduction path, or any combination thereof is intended to mean a significant amount of current flows through such transistor, switch, conduction path, or any combination thereof when on, and no current or an insignificant amount of current (e.g., leakage current) flows through such transistor, switch, conduction path, or any combination thereof when off.

The term "organic electronic device" is intended to mean a device including one or more organic semiconductor layers or materials. Organic electronic devices include: (1) devices that convert electrical energy into radiation (e.g., a light-emitting diode, light-emitting diode display, diode laser, or lighting panel), (2) devices that detect signals through electronics processes (e.g., photodetectors (e.g., photoconductive cells, photoresistors, photoswitches, phototransistors, phototubes), infrared ("IR") detectors, biosensors), (3) devices that convert radiation into electrical energy (e.g., a photovoltaic device or solar cell), and (4) devices that include one or more electronic components that include one or more organic semiconductor layers (e.g., a transistor or diode).

The term "parallel," when referring to a combination of one or more electronic components, one or more circuits, one or more system, or any combination thereof is intended to mean one set of electrodes, regions, terminals, or any combination thereof of such combination are connected together and another set of electrodes, regions, terminals, or any combination thereof of such combination. For example, two field-effect transistors are connected in parallel if their one pair of source/drain regions is connected together and the other pair of source/drain regions is connected together.

The term "polarity," when referring to a voltage is intended to mean that such voltage lies on one side of a reference voltage. Polarities are typically expressed as "+" or "−" with respect to the reference voltage.

The term "polysilicon" is intended to mean a layer of silicon made up of randomly oriented crystals.

The term "power supply line" is intended to mean a signal line having a primary function of transmitting power.

The term "radiation-emitting component" is intended to mean an electronic component, which when properly biased, emits radiation at a targeted wavelength or spectrum of wavelengths. The radiation may be within the visible-light spectrum or outside the visible-light spectrum (ultraviolet ("UV") or IR). A light-emitting diode is an example of a radiation-emitting component.

The term "radiation-responsive component" is intended to mean an electronic component, which when properly biased, can sense or respond to radiation at a targeted wavelength or spectrum of wavelengths. The radiation may be within the visible-light spectrum or outside the visible-light spectrum (UV or IR). IR sensors, biosensors, and photovoltaic cells are examples of radiation-responsive components.

The term "reference voltage" is intended to mean a voltage that acts as a reference to one or more other voltages. Examples of reference voltages include $V_{ss}$, ground potential, or any combination thereof.

The term "respond," when referring to a radiation-responsive electronic component, is intended to mean the production of a signal by the radiation-responsive electronic device to radiation at a targeted wavelength or spectrum of wavelengths.

The term "signal" is intended to mean a current, a voltage, an optical signal, or any combination thereof. The signal can be a voltage or current from a power supply or can represent, by itself or in combination with other signal(s), data or other information. Optical signals can be based on pulses, intensity, or a combination thereof. Signals may be substantially constant (e.g., power supply voltages) or may vary over time (e.g., one voltage for on and another voltage for off).

The term "source/drain region" is intended to mean a region of a field-effect transistor that injects carriers into a channel region or receives carriers from the channel region. A source/drain region can include a source region or a drain region, depending on the flow of current through the field-effect transistor. A source/drain region may act as source region when current flows in one direction through the field-effect transistor, and as a drain region when current flows in the opposite direction through the field-effect transistor.

The term "substantial fraction" is intended to mean a fraction of something causing a quantifiable or perceptible change such that a state of at least a portion of an electronic component, a circuit, a system, etc. has been changed. For example, a field-effect transistor has trapped charge carriers within its gate dielectric layer. By removing a substantial fraction of the charge carriers from the gate dielectric layer, the threshold voltage can be changed from a prior charged state to a more neutral current state.

The term "substantially equal" is intended to mean that two or more values of parameters are equal or almost equal such that any inequality is considered to be insignificant to one of ordinary skill in the art.

The term "terminal" is intended to mean a part of one or more electronic component, circuit, system, subsystem, or any combination thereof that is configured to receive a signal. Terminal is to be construed broadly. Non-limiting examples of terminals include electrodes (gate electrodes, anodes, cathodes, capacitor electrodes), regions (source/drain regions, collector regions, base regions, emitter regions), and combinations thereof.

The term "threshold voltage recovery" is intended to mean an act or operation in which a threshold voltage of a field-effect transistor is changed to a threshold voltage of the field-effect transistor at or near a prior state. For example, a threshold voltage recovery may be performed to return a threshold voltage of a field-effect transistor to a value at or near a threshold voltage when the field-effect transistor was originally fabricated.

The term "trap" and its variants, with respect to charge carriers, is intended to mean that at least one charge carrier migrates into or resides within a layer, member, structure, or combination thereof, and other than removing all or part of such layer, member, structure, or combination thereof, such at least one charge carrier is not removed from such layer, member, structure, or combination thereof, unless an electrical field of a proper polarity and sufficient strength is applied to such layer, member, structure, or combination thereof for a sufficient length of time.

The term "voltage-time product" is intended to mean a product of a voltage and the time period that such voltage is applied to an electronic component or a portion thereof.

As used herein, the terms "comprises," "comprising," "includes," "including," "has," "having" or any other variation thereof, are intended to cover a non-exclusive inclusion. For example, a method, process, article, or apparatus that comprises a list of elements is not necessarily limited only those elements but may include other elements not expressly listed or inherent to such method, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Group numbers corresponding to columns within the periodic table of the elements use the "New Notation" convention as seen in the CRC Handbook of Chemistry and Physics, 81st Edition (2000).

To the extent not described herein, many details regarding specific materials, processing acts, and circuits are conventional and may be found in textbooks and other sources within the organic light-emitting display, photodetector, semiconductor and microelectronic circuit arts.

2. Threshold Voltage and Trapped Charge

Embodiments described herein can allow for hardware modifications to address the problems associated with changing (i.e., drifting) threshold voltage for a field-effect transistor having a gate dielectric layer. The change in the threshold voltage is due to trapped charge carriers accumulating within the gate dielectric layer of the field-effect transistor. The equation below quantifies the relationship between threshold voltage and trapped charge carriers.

$$\Delta V_{th}=q^*\Delta N_{trap}/C_{gd}$$

wherein, $\Delta V_{th}$ is the threshold voltage drift;

$\Delta N_{trap}$ is the number of trapped charges after gate biasing; and $C_{gd}$ is the capacitance of the gate dielectric layer.

The problems caused by trapped charge carriers in the gate dielectric layer can occur with nearly any field-effect transistor, but are more problematic when the source/drain regions and channel region of the field-effect transistor are formed (e.g., deposited) as amorphous silicon (a-Si), low-temperature polysilicon (LTPS), continuous grain silicon (CGS), or any combination thereof.

Figure 2:
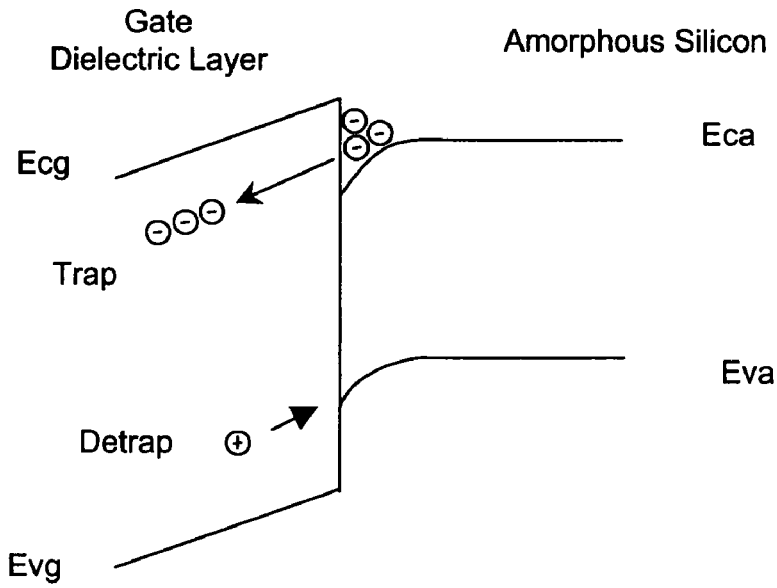
FIGS. 2 and 3 include band diagrams illustrating the trapping and de-trapping of charges within a gate dielectric layer.
Figure 3:
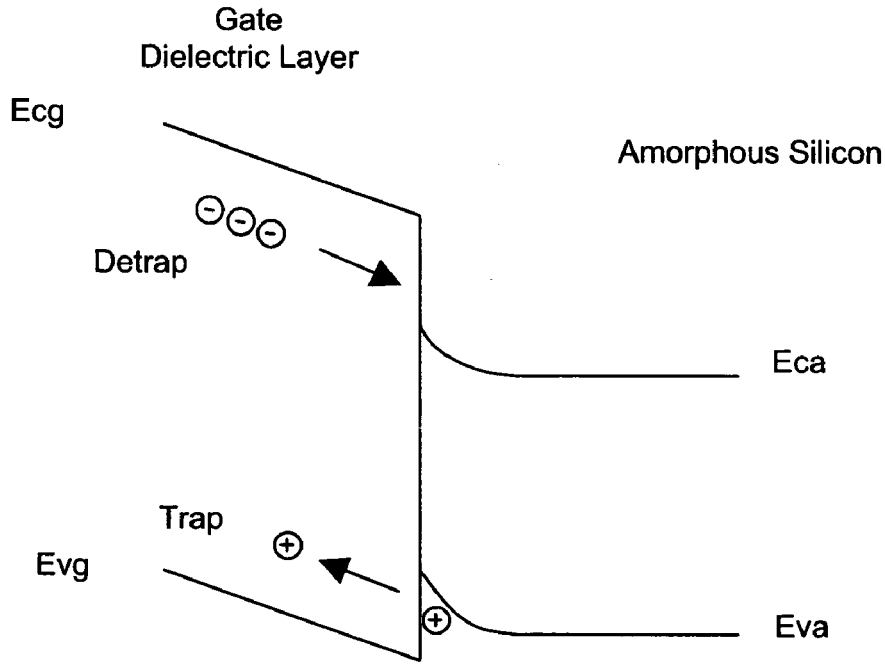

When a positive bias is placed on the gate electrode of a field-effect transistor as illustrated in FIG. 2, electrons are trapped within the gate dielectric layer, and holes are de-trapped from the gate dielectric layer. When a negative bias is placed on the gate electrode as illustrated in FIG. 3, electrons are de-trapped from the gate dielectric layer, and holes are trapped within the gate dielectric layer. As will be described in more detail below, circuits and structures can be used to reverse the affects of trapping too much charge within a gate dielectric layer.

3. Exemplary Circuits

Figure 4:
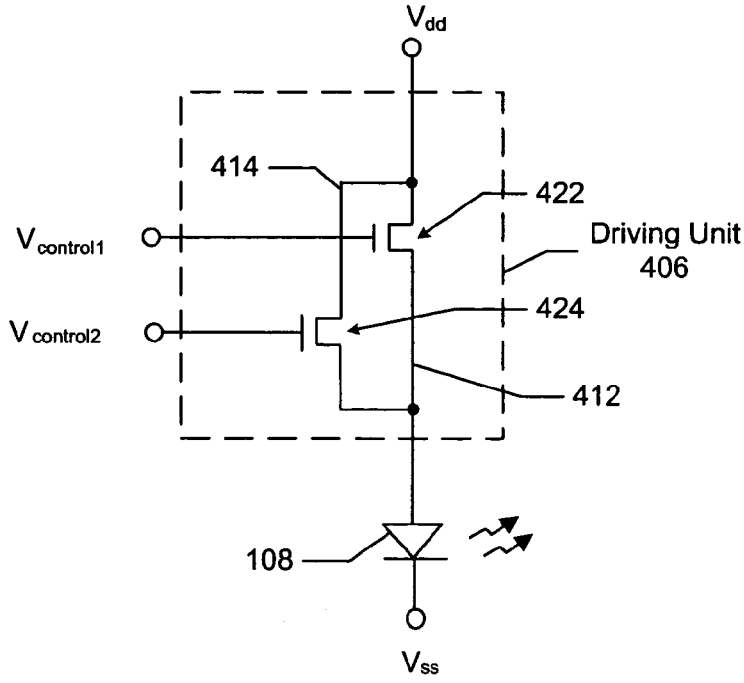
FIGS. 4 and 5 include component-level diagrams of driving units in accordance with different embodiments.
Figure 5:
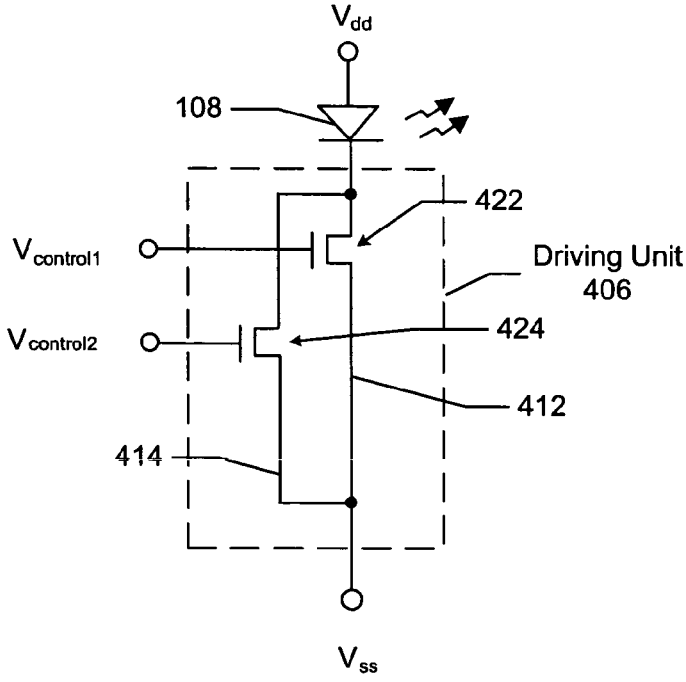

FIGS. 4 and 5 include circuit diagrams of a driving unit 406 that includes two parallel conduction paths 412 and 414. The first conduction path 412 includes a first field-effect transistor 422, and the second conduction path 414 includes a second field-effect transistor 424, wherein the first and second conduction paths 412 and 414 are connected in parallel. Each of the first and second field-effect transistors 422 and 424 includes a gate electrode, a gate dielectric layer, a first source/drain region, a second source/drain region, and a channel region lying between the first and second source/drain regions. In one embodiment, at least portions of the first and second source/drain regions and the channel region are formed as amorphous silicon (a-Si), low-temperature polysilicon (LTPS), continuous grain silicon (CGS), or any combination thereof. In another embodiment, the first and second source/drain regions and the channel region include substantially monocrystalline silicon. In other embodiments, other Group 14 elements (e.g., carbon, germanium), by themselves or in combination (with or without silicon), may be used for the first and second source/drain regions and channel regions. In still other embodiments, the first and second source/drain regions and the channel region include III-V (Group 13-Group 15) semiconductors (e.g., GaAs, InP, GaAlAs, etc.), III-VI (Group 2-Group 16 or Group 12-Group 16) semiconductors (e.g., CdTe, CdSe, CdZnTe, ZnSe, ZnTe, etc.), or any combination thereof.

In one embodiment as illustrated in FIG. 4, the first source/drain regions of the first and second field-effect transistors act as source regions and are connected to each other and an anode of an electronic component 108. The second source/drain regions of the first and second field-effect transistors 422 and 424 acts as drain regions and are connected to each other and a first power supply line, $V_{dd}$. In one embodiment, the electronic component 108 is a radiation-emitting electronic component, in another embodiment, the electronic component 108 is a radiation-responsive electronic component, in still another embodiment, the electronic component 108 is an organic electronic component, and in a specific embodiment, the electronic component 108 is an OLED. The cathode of the electronic component 108 is connected to a second power supply line, $V_{ss}$. The gate electrode of the first field-effect transistor 422 is coupled to a first control line, and the gate electrode of the second field-effect transistor 424 is coupled to a second control line. In one embodiment, the first and second control lines ($V_{control1}$ and $V_{control2}$) can receive data from first and second data lines. The gate electrode of each of the first and second field-effect transistors 422 and 424 may or may not be coupled to the other field-effect transistor within the driving unit 406.

Regarding the power supplies, $V_{dd}$ and $V_{ss}$ are a relatively positive power supply voltage and a relatively negative power supply voltage, respectively. The actual voltages of $V_{dd}$ and $V_{ss}$ may be positive, negative, zero, or any combination thereof. The voltage differential between $V_{dd}$ and $V_{ss}$ is typically more important than the actual values of $V_{dd}$ and $V_{ss}$, as electronic components may operate based on the voltage difference. In one embodiment, the voltage difference between $V_{dd}$ and $V_{ss}$ may be 10 volts.

FIG. 5 illustrates another embodiment, in which the radiation-emitting electronic component 108 and the driving unit 406 are reversed. The anode of the electronic component 108 is connected to the $V_{dd}$ line, and the cathode of the electronic component 108 is connected to the first source/drain regions of the first and second field-effect transistors 422 and 424. The second source/drain regions of the first and second field-effect transistors 422 and 424 and the $V_{ss}$ line are connected to one another. In one embodiment, the first source/drain regions of the first and second field-effect transistors act as drain regions, and the second source/drain regions of the first and second field-effect transistors act as source regions. In another embodiment, the first and second control lines ($V_{control1}$ and $V_{control2}$) can receive data from first and second data lines, respectively. The gate electrode of each of the first and second field-effect transistors 422 and 424 may or may not be coupled to the other field-effect transistor within the driving unit 406.

While FIGS. 4 and 5 illustrate enhancement-mode, n-channel transistors for the first and second field-effect transistors, many other types of field-effect transistors may be used. The first and second field-effect transistors may be depletion-mode transistors, enhancement-mode transistors, p-channel transistors, n-channel transistors, or any combination thereof.

In another embodiment, more than two field-effect transistors may be connected is parallel to provide additional parallel conduction paths. In a further embodiment, more than one electronic component may lie along a conduction path. One or more diode, resistor, switch, transistor, or any combination thereof may lie along any one or more conduction path between a power supply line ($V_{dd}$ or $V_{ss}$) and the electronic component 108. For switches and transistors, their current carrying electrodes or terminals would line along the conduction path. The control electrodes (e.g., gate electrodes) may or may not be connected to any one or more conduction path between a power supply line and the electronic component 108.

Figure 6:
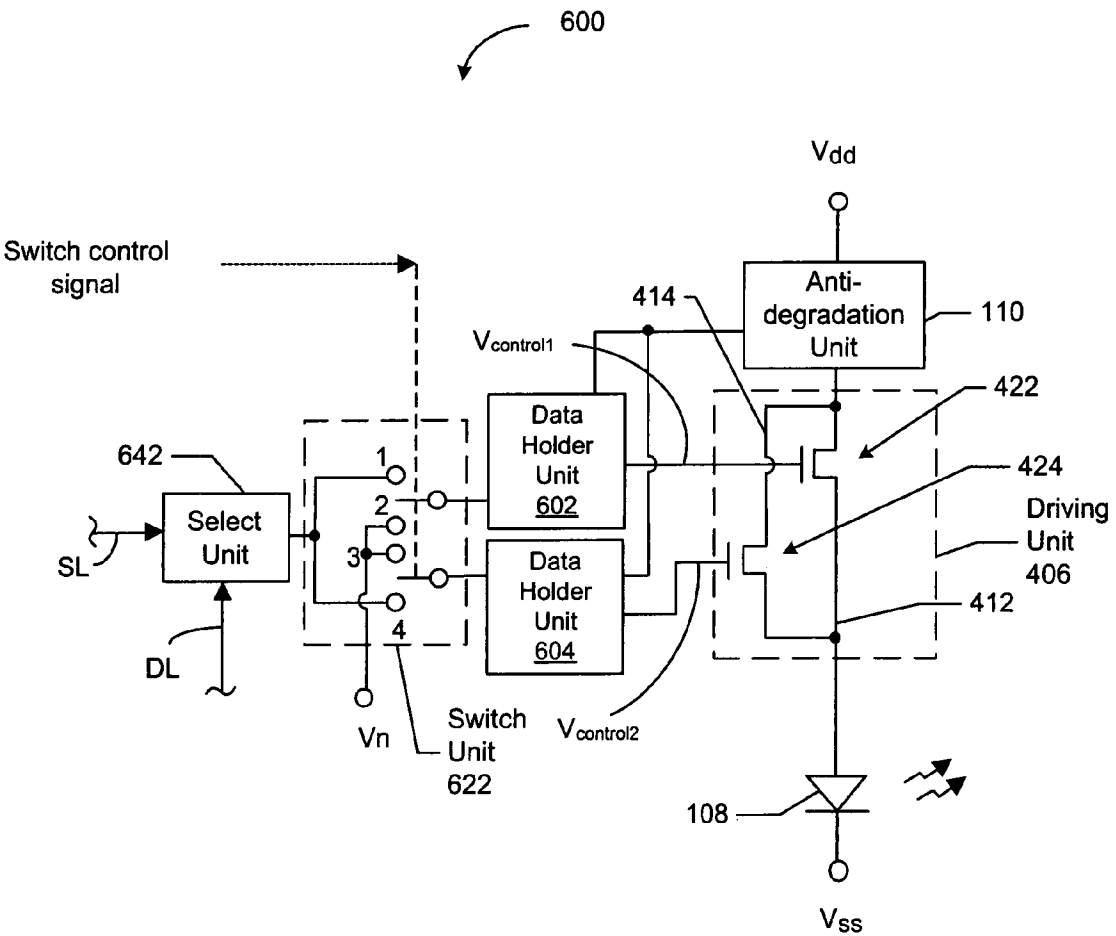
FIGS. 6 and 7 include block diagrams of one embodiment including a select unit, a switch unit, data holder units, and the driving unit of FIGS. 4 and 5, respectively.
Figure 7:
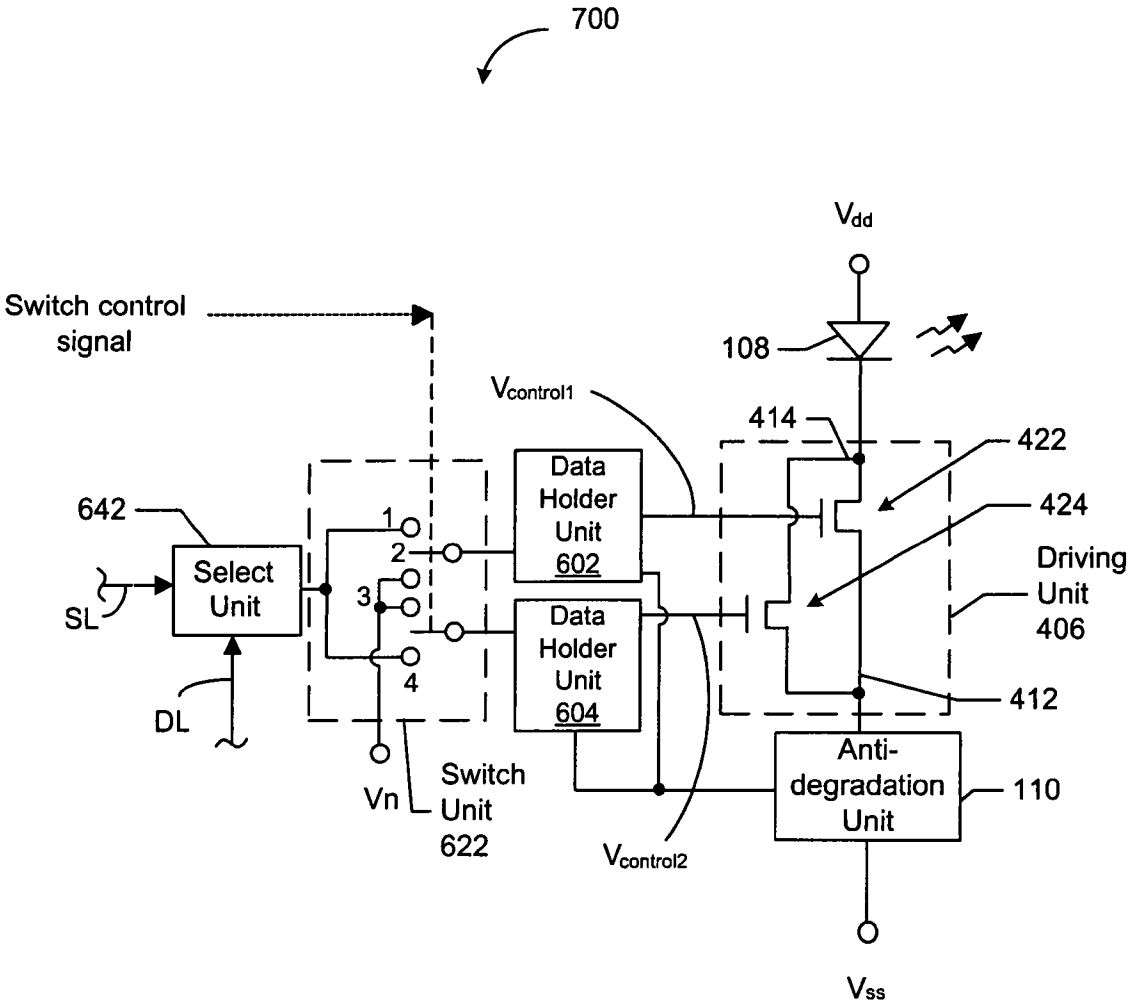

FIGS. 6 and 7 include block diagrams illustrating the driving unit 406 and electronic component 108 with respect to other parts of an electronic device 600. An anti-degradation unit 110 lies between the driving unit 406 and the $V_{dd}$ line and is connected to data holders 602 and 604. In another embodiment, the anti-degradation unit 110 is not present and each of the data holder units 602 and 604, and driving unit 406 is electrically connected to the $V_{dd}$ line. The data holder units 602 and 604 can temporarily store signals to be transmitted to gate electrodes of the first and second field-effect transistors 422 and 424. In one embodiment, each of the data holder units 602 and 604 includes a capacitive electronic component. In a more specific embodiment, the first electrode of the capacitive electronic component within data holder unit 602 is connected to the gate electrode of the first field-effect transistor 422, and the second electrode of the capacitive electronic component within data holder unit 602 is connected to the $V_{dd}$ line. In the same or different specific embodiment, the first electrode of the capacitive electronic component within data holder unit 604 is connected to the gate electrode of the second field-effect transistor 424, and the second electrode of the capacitive electronic component within data holder unit 604 is connected to the $V_{dd}$ line.

A switch unit 622 is connected to data holder units 602 and 604, a select unit 642, and a $V_n$ line. The switch unit 622 is configured to receive a switch control signal that can be used to determine the positions of the terminals within the switch unit 622. In one embodiment, the switch unit is a conventional double-pole, double-throw switch. Within the switch unit 622, poles 1 and 4 are connected to the select unit 642, and poles 2 and 3 are connected to the $V_n$ line. During odd frames, the switch control signal causes the switches within the switch unit 622 to be connected to the 1 and 3 poles, and during even frames, the switch control signal causes the switches within the switch unit 622 to be connected to the 2 and 4 poles. Note that the switch unit 622 may have its switches connected to the poles during any or all of the odd frame or the even frame.

The select unit 642 is connected to a data line, DL, and a select line, SL. SL provides a control signal for select unit 642, and DL provides a data signal to be passed to one of the data holder units 602 or 604 when the select unit 642 is activated. In one embodiment, the select unit 642 includes a field-effect transistor, wherein a first source/drain region is connected to DL, a second source drain region is connected to the switch unit 622, and a gate electrode is connected to SL. In other embodiments, other transistors (including JFETs and bipolar transistors), switches, or any combination thereof may be used within the select unit 642. In still other embodiments, more or different electronic component(s) can be used within the select unit 642.

In one embodiment, all of the select, switch, data holder, anti-degradation, and driving units as illustrated in FIG. 6 may lie within the array. In one specific embodiment, each electronic component 108 may have its own set of select, switch, data holder, anti-degradation, and driving units. In another embodiment, one or all of the units may lie outside the array (e.g., within peripheral circuitry).

FIG. 7 illustrates a similar electronic device 700. In FIG. 7, the placement of the anti-degradation unit 110, driving unit 406, and electronic component 108 are reversed with respect to the power supply lines $V_{dd}$ and $V_{ss}$. For the remainder of the specification, skilled artisans will appreciate that placement of the anti-degradation unit 110, driving unit 406, and electronic component 108 with respect to the power supply lines $V_{dd}$ and $V_{ss}$ can be either of the type illustrated in FIG. 6 or FIG. 7. Therefore, although in the remainder of the specification, the placement of the anti-degradation unit 110, driving unit 406, and electronic component 108 with respect to the power supply lines $V_{dd}$ and $V_{ss}$ is of the type illustrated in FIG. 6, skilled artisans appreciate that the placement of the anti-degradation unit 110, driving unit 406, and electronic component 108 with respect to the power supply lines $V_{dd}$ and $V_{ss}$ as depicted in FIG. 7 may be used.

Figure 8:
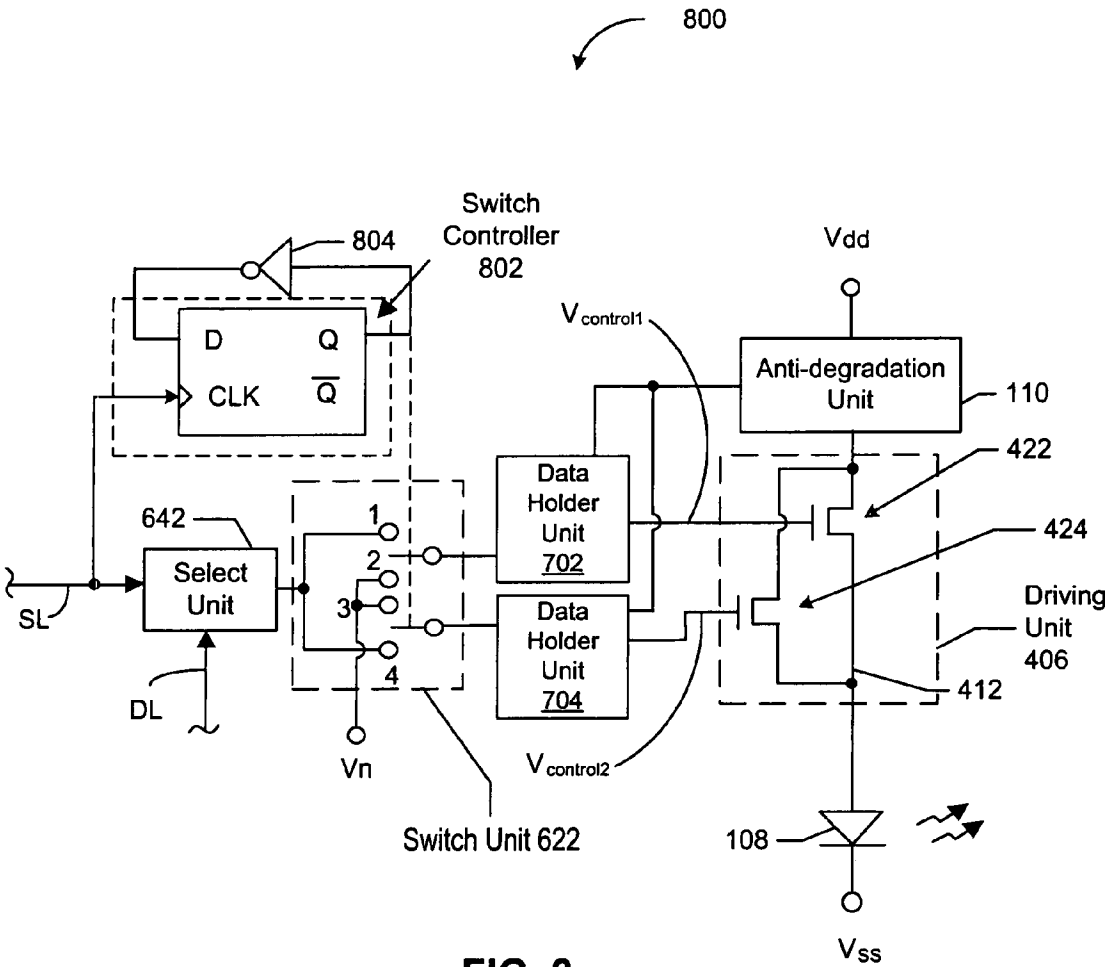
FIG. 8 includes a block diagram of a switch controller that can be used with the select, switch, data holder, and driving units of FIG. 6.

FIG. 8 includes a switch controller 802 that can provide the switch control signal to the switch unit 622. In one embodiment, the switch controller 802 includes a D flip-flop circuit, which includes D and CLK inputs and Q and $Q_{bar}$ outputs. CLK can be connected to a control signal. In one embodiment, CLK is connected to SL. An inverter 804 has an input connected to Q and an output connected to D. When CLK receives a signal from the select line, the signal on D is passed to Q. After the select line is deactivated, the signal from Q is inverted by the inverter 804 and provided to D. If D was in a low, 0, or false state, the signal is changed to a high, 1, or true state. After the next signal from SL is received, the then-current value of D is passed to Q. Therefore, the D flip-flop allows for a bi-stable operation that can be used to provide switch control signals to the switch unit 622. The switch controller 802 may lie within the array or may lie outside of the array. In one embodiment, each pixel driver circuit can include a switch controller 802, and in another embodiment, the switch controller 802 may be shared with other pixel driver circuits.

Figure 9:
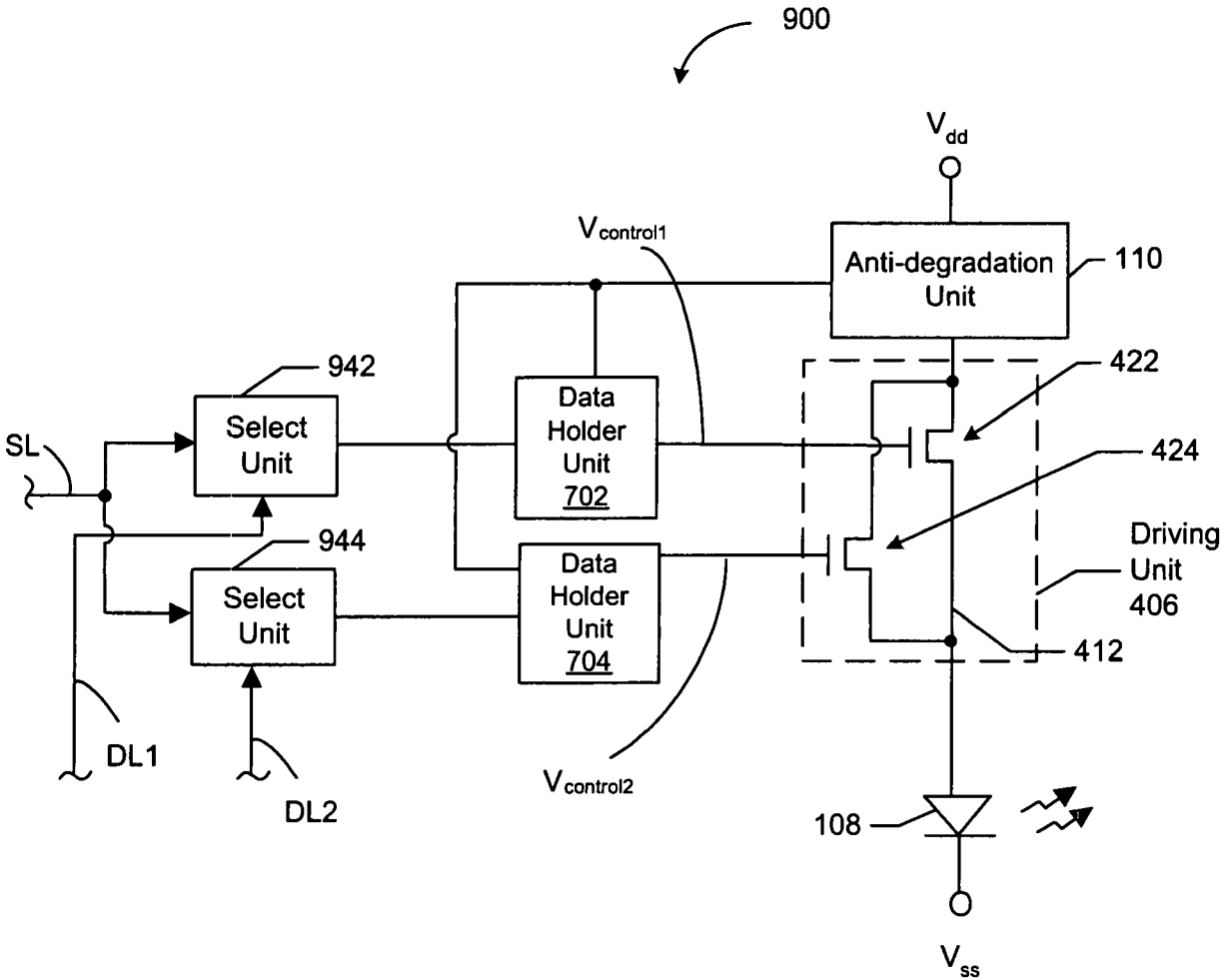
FIG. 9 includes a block diagram of an embodiment, wherein the select and switch units in FIG. 6 are replaced by select units separately connected to the data holder units.

FIG. 9 includes an embodiment that does not require a switch unit or switch controller. The electronic device 900 in FIG. 9 includes select unit 942 and select unit 944. Select unit 942 is connected to SL, data line 1 (DL1), and data holder unit 702; and select unit 944 is connected to SL, data line 2 (DL2), and data holder unit 704. Any of the components previously described for use with the select unit 642 may be used for corresponding components in the select units 942, 944, or both. In one embodiment, during odd frames, data signals (e.g., for an image) may be provided by DL1, and $V_n$ may be provided by DL2, and during even frames, $V_n$ may be provided by DL1, and data signals (e.g., for an image) may be provided by DL2.

Figure 10:
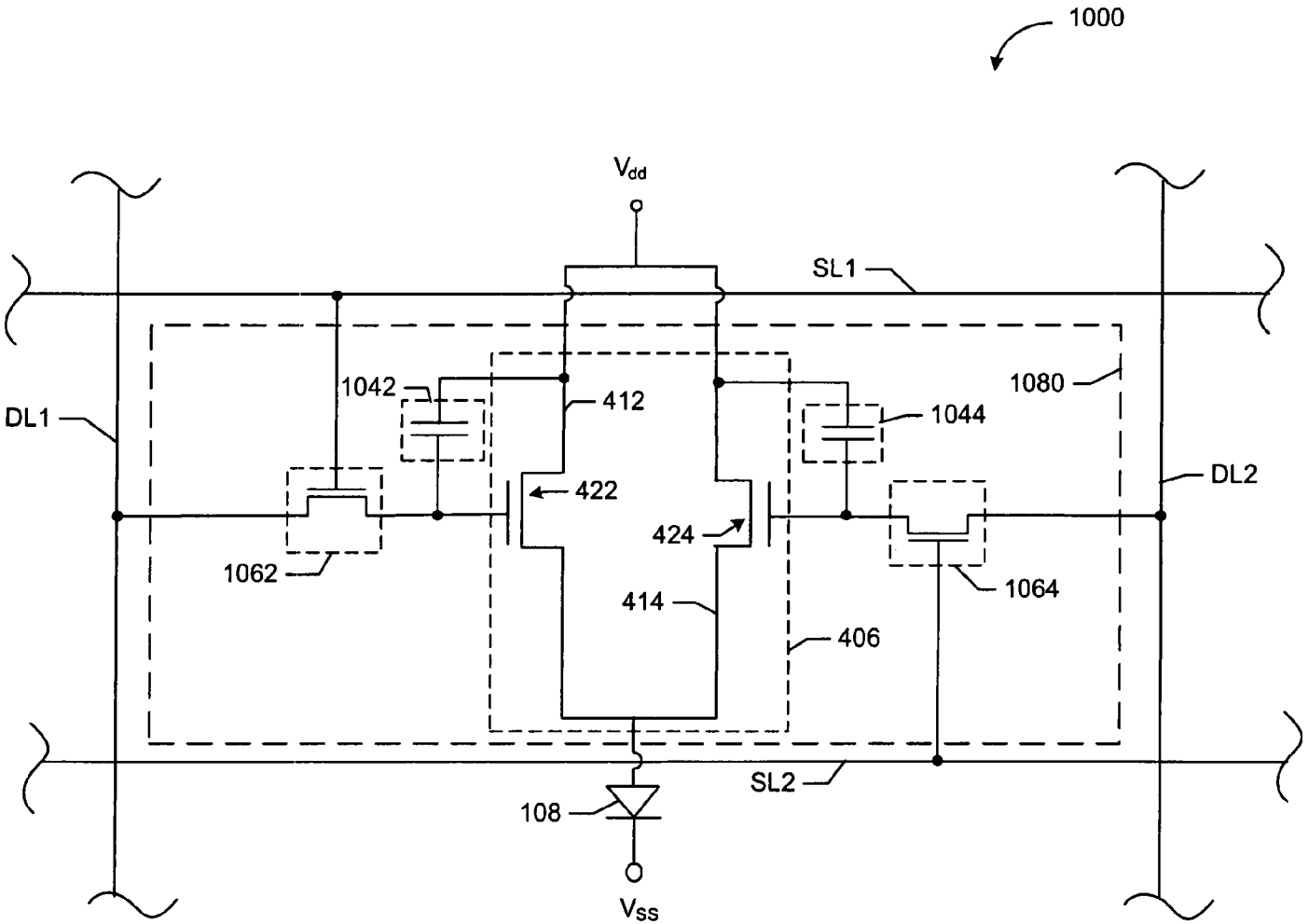
FIG. 10 includes a circuit diagram of an embodiment where separate select lines are connected to the gate electrodes of select transistors.

In another embodiment, separate select lines may be used. FIG. 10 illustrates a specific embodiment of an electronic device 1000 using separate select lines SL1 and SL2. FIG. 10 also illustrates specific electronic components that can be used. The optional anti-degradation unit is not used in this embodiment; however, in another embodiment, the optional anti-degradation unit can be used. The electronic device 1000 includes a pixel driver circuit 1080. The pixel driver circuit includes a driving unit 406, data holder units 1042 and 1044, and select units 1062 and 1064. The driving unit 406 includes the first conductive path 412 including the first field-effect transistor 422, and a second conductive path 414 including the second field-effect transistor 424. The data holder units 1042 and 1044 each include a capacitive electronic component. Each of the select units 1062 and 1064 includes a field-effect transistor. In other embodiments, other transistors (including JFETs and bipolar transistors), switches, or any combination thereof may be used within the select units 1062 and 1064.

Figure 11:
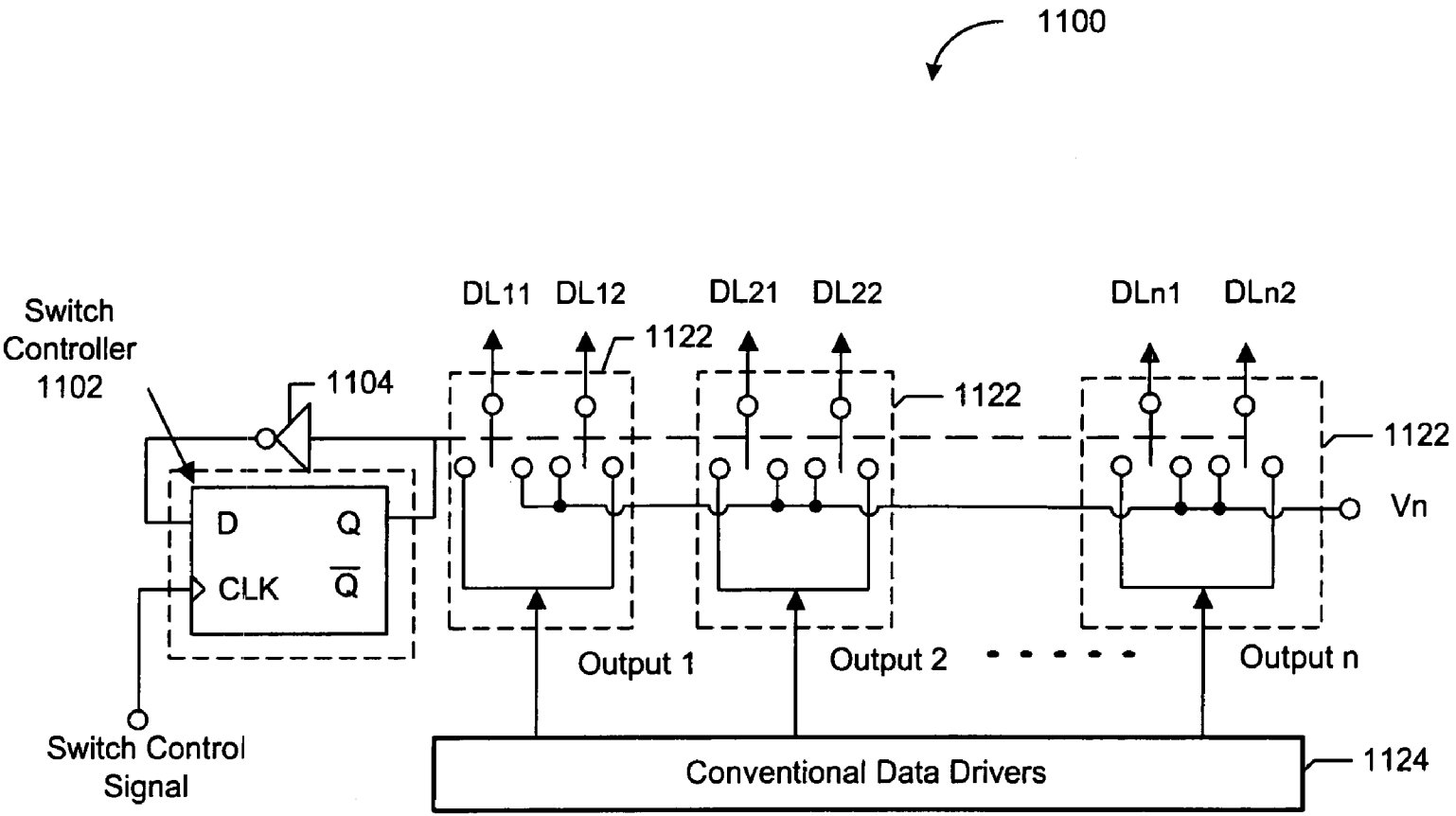
FIG. 11 includes a block diagram of an embodiment wherein switch controller and switch units are located outside an array.

FIG. 11 includes another embodiment of an electronic device 1100 wherein switch units 1122, which may or may not be the same as switch units 622, and switch controller 1102 lie outside the array. In the embodiment as illustrated in FIG. 11, each switch unit 1122 is coupled to a column of electronic components, similar to electronic component 108. The switch units 1122 are connected to data lines $DL_{11}$ to $DL_{n1}$ and to $DL_{12}$ to $DL_{n2}$. The switch controller 1102 includes an input connected to a switch control signal line and an output is coupled to all the switch units 1122. In another embodiment, the orientation of the array may be changed so that each of the switch units 1122 corresponds to a row of electronic components, similar to electronic component 108. Each of the switch units 1122 is coupled to outputs from a conventional data driver 1124. In one embodiment, the operation of the switch controller 1102, inverter 1104, and switch units 1122 are substantially identical to the switch controller 802, inverter 804, and switch unit 622 as previously described.

Figure 12:
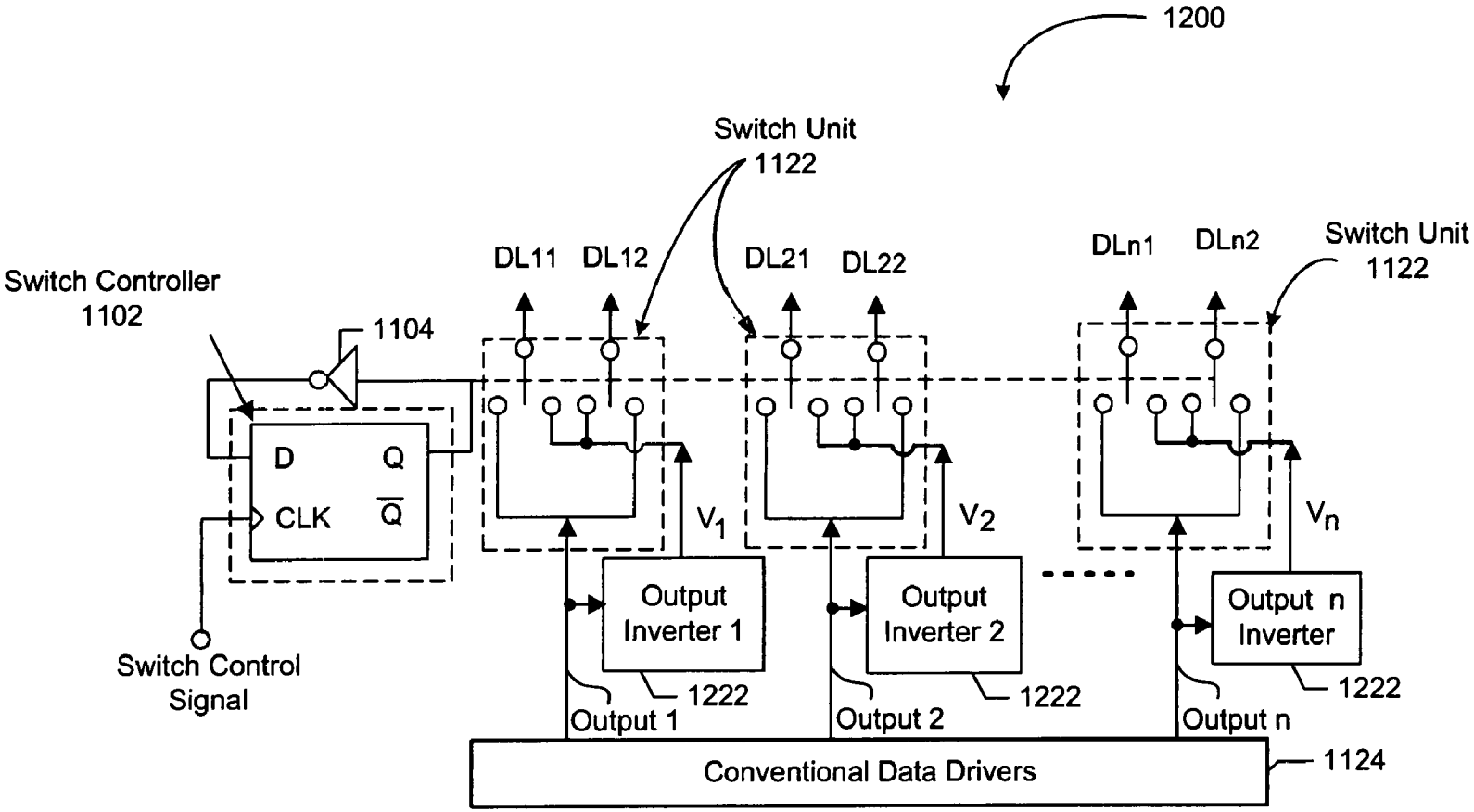
FIG. 12 includes a block diagram of an embodiment wherein switch controller and switch units are located outside an array, and wherein an inverted data signal is used.
Figure 13:
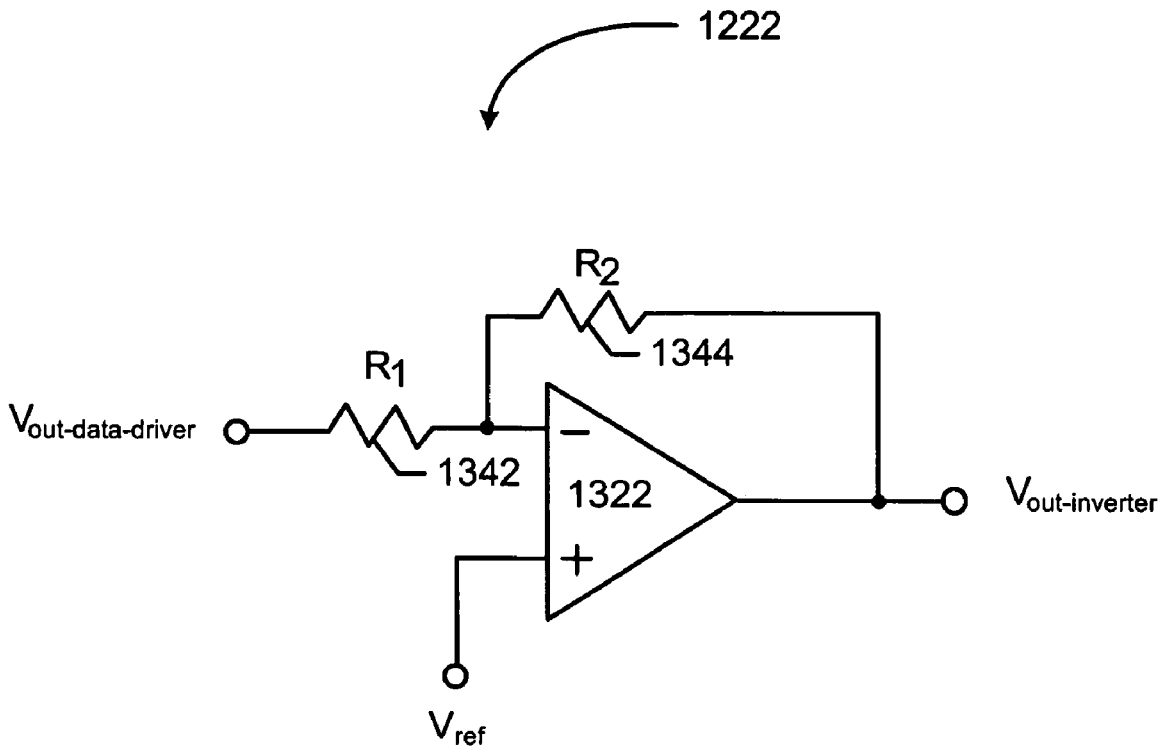
FIG. 13 includes a circuit diagram of an inverter that can be used with the embodiment of FIG. 12.

FIG. 12 includes still another embodiment of an electronic device 1200 in which $V_n$ is replaced by outputs from output inverters 1222. Each of the output inverters 1222 has an input connected to an output of the corresponding conventional data driver 1124 and an output connected to poles 2 and 3 of the corresponding switch unit 1122. FIG. 13 includes a circuit diagram of a non-limiting embodiment of an output inverter 1222. The output inverter 1222 includes a differential amplifier 1322, a first resistive electronic component 1342, and a second resistive electronic component 1344. A reference signal line, $V_{ref}$, is input to the first (positive) input of the differential amplifier 1322. A first terminal of the first resistive electronic component 1342 is connected to an output from the conventional data driver 1124, and a second terminal of the first resistive electronic component 1342 is connected to a second (negative) input of the differential amplifier 1322. A first terminal of the second resistive electronic component 1344 is connected to an output from the differential amplifier 1322, and a second terminal of the second resistive electronic component 1344 is connected to the second terminal of the first resistive electronic component 1342 and the second input of the differential amplifier 1322. The output voltage of the output inverter 1222 is given in Equation 1.

$$V_{out\text{-}inverter}=V_{ref}*(R_1+R_2)/R_1-V_{out\text{-}data\text{-}driver}*R_2/R_1 \qquad \text{Equation 1}$$

wherein:

$V_{out\text{-}inverter}$ is the output voltage of the output inverter 1222;

$V_{ref}$ is the reference voltage;

$R_1$ is the resistance of the first resistive electronic component 1342; and $R_2$ is the resistance of the second resistive electronic component 1344.

In one embodiment, the differential amplifier 1322 is part of an operational amplifier. In another embodiment, the differential amplifier 1322 and any one or more of resistive electronic components 1342 and 1344 are part of the same operation amplifier. In still another embodiment, differential amplifier 1322 is not part of an operational amplifier. The actual resistance of resistive electronic components 1342 or 1344 is not critical. In one embodiment, the resistances of resistive electronic component 1342 and 1344 is in a range of approximately 1 Kohm to 1 Mohm, and $V_{ref}$ is in a range of approximately −10 to +10 volts.

4. Methodology

Attention is now directed to methods of operating an electronic device having parallel conduction paths and a radiation-emitting electronic component, a radiation-responsive electronic component or both. Although any of the circuits and other portions of the electronic components can be used with the method, the description of the methodology will be described with respect to the electronic device 600 in FIG. 6, wherein the electronic component 108 is a radiation-emitting electronic component. Other electronic devices described or illustrated herein will be addressed to the extent its operation substantially differs from that of FIG. 6. After reading this specification, skilled artisans will be able to design electronic devices that may use the circuits, methods portions thereof, or any combination thereof.

Figure 14:
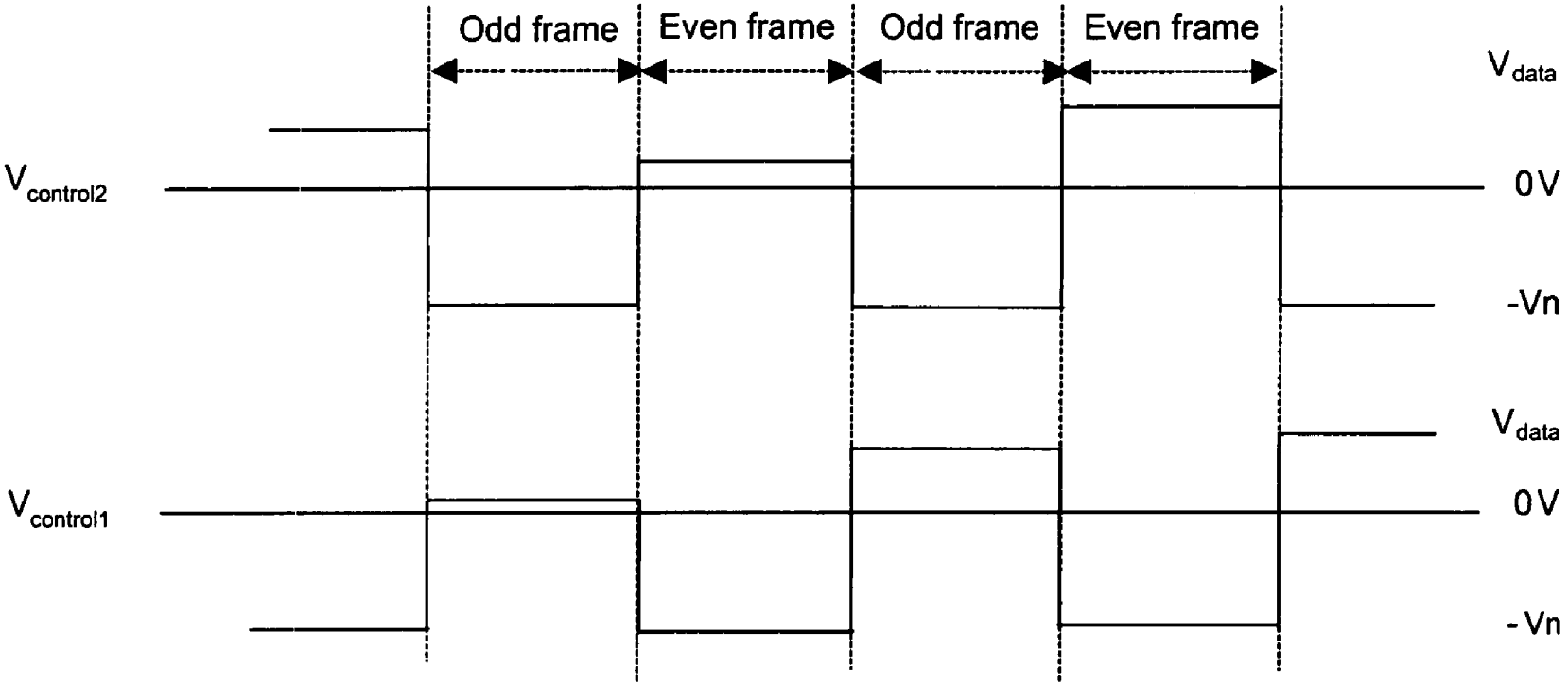
FIG. 14 includes a timing diagram for signals sent to the gate electrodes for field-effect transistors within the driving unit in FIG. 6.
Figure 15:
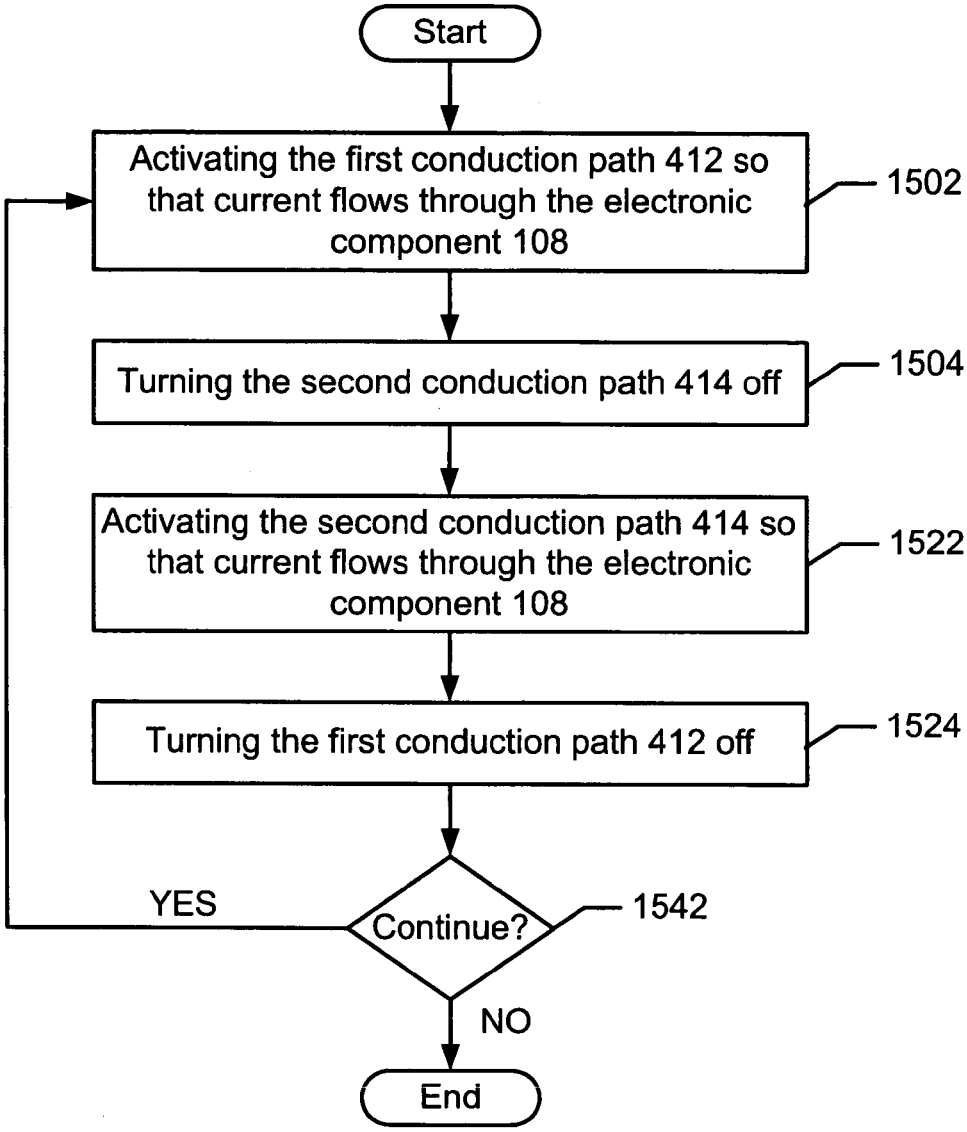
FIG. 15 includes a flow chart of a first method for operating an electronic device.

FIG. 14 includes a timing diagram for use with FIG. 6. FIG. 15 includes a flow diagram for use with the timing diagram. The time units can be divided into odd frames (e.g., first time periods) and even frames (e.g., second time periods). In one embodiment, the even and odd frames last for the same time duration. In another embodiment, they may last for different time durations. In one embodiment, the frames can correspond to a frame time (approximately 1/60 second), portions or multiples thereof, or nearly any other length of time. In still another embodiment, either or both of the even and odd frames may be an integer multiple of a clock signal for the electronic device.

Referring to FIG. 6, during an odd frame, a switch control signal is received by the switch unit 622, which connects the data holder units 602 and 604 to poles 1 and 3, respectively, within switch unit 622. A select signal on SL is received by select unit 642 and activates the select unit 642. A data signal, $V_{data}$, along DL is transmitted by the select unit 642 and switch unit 622 to and is received by the data holder unit 602 and the gate electrode of the first field-effect transistor 422 as $V_{control1}$. The $V_{data}$ may correspond to an image that is to be displayed by the electronic device 600. A threshold voltage recovery signal, $V_n$, is transmitted by the switch unit 622 and is received by the data holder unit 604 and the gate electrode of the second field-effect transistor 424 as $V_{control2}$. In one embodiment, $V_{data}$ corresponds to one or more images to be displayed by the electronic device 600.

$V_{data}$ has a sufficiently high voltage to turn on the first field-effect transistor 422, which activates the first conduction path 412, and allows current to flow through the first conduction path 412 and the electronic component 108 (block 1502 in FIG. 15). The emission intensity from the electronic component 108 is a function of the voltage on the gate electrode of the first field-effect transistor 422. While the first field-effect transistor 422 is on, electrons, holes, of both may become trapped within the gate dielectric layer of the first field-effect transistor 422. In one embodiment, $V_{data}$ has a positive polarity compared to $V_{ss}$, and $V_n$ has a negative polarity compared to $V_{ss}$.

$V_n$ on $V_{control2}$ reverses the bias on the gate electrode of the second field-effect transistor 424 as compared to the voltage on the gate electrode of the second field-effect transistor 424 during a prior even frame. $V_n$ turns off the second field-effect transistor 424, and no significant current flows through the second conduction path 414. Therefore, the second conduction path 414 is off (block 1504 in FIG. 15). $V_n$ allows trapped charge carriers, which became trapped during the prior even frame, to become de-trapped from the gate dielectric layer of the second field-effect transistor 424 during a prior even frame. FIG. 14 includes the signals on $V_{control1}$ and $V_{control2}$ during the odd frames. In another embodiment, $V_n$ may be a time-varying signal (e.g., alternating current, exponential or asymptotic increase or decrease, or any combination thereof).

During an even frame, a switch control signal is received by the switch unit 622, which connects the data holder units 602 and 604 to poles 2 and 4, respectively, within switch unit 622. A select signal on SL is received by select unit 642 and activates the select unit 642. A data signal, $V_{data}$, along DL is transmitted by the select unit 642 and switch unit 622 to and is received by the data holder unit 604 and the gate electrode of the second field-effect transistor 424 as $V_{control2}$. The $V_{data}$ may correspond to an image that is to be displayed by the electronic device 600. A threshold voltage recovery signal, $V_n$, is transmitted by the switch unit 622 to the data holder unit 602 and is received by the gate electrode of the first field-effect transistor 422 as $V_{control1}$.

$V_{data}$ has a sufficiently high voltage to turn on the second field-effect transistor 424, which activates the second conduction path 414, and allows current to flow through the second conduction path 414 and the electronic component 108 (block 1522 in FIG. 15). The emission intensity from the electronic component 108 is a function of the voltage on the gate electrode of the second field-effect transistor 424. While the second field-effect transistor 424 is on, electrons, holes, of both may become trapped within the gate dielectric of the second field-effect transistor 424. $V_n$ on $V_{control1}$ reverses the bias on the gate electrode of the first field-effect transistor 422 compared to a prior odd frame. $V_n$ turns off the first field-effect transistor 422, and no significant current flows through the first conduction path 412. Therefore, the first conduction path 412 is off (block 1524 in FIG. 15). $V_n$ allows trapped charge carriers, which became trapped during the prior odd frame, to become de-trapped from the gate dielectric layer of the first field-effect transistor 422 during the even frame. FIG. 14 includes the signals on $V_{control1}$ and $V_{control2}$ during the even frames.

A decision is made whether to continue (diamond 1542 in FIG. 15). If yes, the process returns to block 1502. While images are to be displayed at the electronic device 600, the method is iterated. Therefore, in one embodiment, the first conduction path 412 allows current to flow during the odd frames but not during the even frames, and the second conduction path 414 allows current to flow during the even frames but not during the odd frames. When no further images are to be displayed or the electronic device is turned off, the method ends ("no" branch from diamond 1542). In another embodiment, another decision diamond (not shown) can be inserted between blocks 1504 and 1522. The decision would be whether to continue in the event there are more odd frames than even frames. The yes branch allows the method to continue to block 1522, and the no branch ends the method.

In one embodiment, as illustrated with the timing diagram in FIG. 14, the voltages on gate electrodes of the first and second field-effect transistors 422 and 424 are opposite each other during each frame. Also, for each of the first and second field-effect transistors 422 and 424, the voltage on the gate electrode during the odd frames is opposite the even frames.

Note that $V_{data}$, $V_n$, or both do not need to be constant between any of the frames and can even change during any one or more frames. In one embodiment, as illustrated in FIG. 14, the emission intensity of the electronic component 108 is increasing with each frame ($V_{data}$ becomes more positive). $V_n$ is illustrated as being constant between frames and during each frame. In another embodiment, $V_{data}$, $V_n$, or both do not need to be constant between any of the frames and can even change during any one or more frames.

In one embodiment, the parallel conduction paths 412 and 414 allow the electronic component 108 to be on substantially all the time (e.g., during the odd and even frames). One conduction path 412 or 414 may allow current to flow to the electronic component 108, while charge carriers are being de-trapped from the gate dielectric layer of the field-effect transistor in the other conduction path.

The actual values for $V_n$ are highly variable and can be determined based on the needs or desires for the specific application. $V_n$ can be a function of the values of the signals on $V_{data}$ during any one or more periods, lengths of time periods, or the like. In one embodiment, the voltage-time products during displaying and threshold voltage recovery are substantially equal.

If the time periods are of substantially the same duration, the voltages or voltage differentials can be used as voltage-time product. The voltage used for the voltage-time products may be $V_{data}$, a voltage differential, or the like.

In one specific embodiment, voltage differentials are used. The electronic component 108 has a 0.5 volt drop when operating. Therefore, the first source/drain regions of the first and second field-effect transistors 422 and 424 are +0.5 volts when $V_{ss}$ is at 0 volts. During the first odd frame (e.g., first time period), $V_{control1}$ on the gate electrode of the first field-effect transistor 422 is +1.0 volts, and therefore, the voltage difference between the gate electrode and first source/drain region of the first field-effect transistor 422, $V_{GFS/D1}$, is +0.5 volts. Because the first source/drain regions of the first and second field-effect transistors 422 and 424 are electrically connected to each other, the voltages on the first source/drain regions of the first and second field-effect transistors 422 and 424 are the same, +0.5 volt. During the first even frame (e.g., second time period), the polarity of the $V_{GFS/D1}$ is reversed and is −0.5 volts. Because the first source/drain region of the first field-effect transistor 422 is at +0.5 volts, $V_n$ may be set to 0 volts during the subsequent first even frame (e.g., second time period).

During the first even frame, $V_{control2}$ on the gate electrode of the second field-effect transistor 424 is +1.5 volts, and therefore, the voltage difference between the gate electrode and first source/drain region of the second field-effect transistor 424, $V_{GFS/D2}$, is +1.0 volts. During a second odd frame (e.g., third time period), the polarity of the $V_{GFS/D2}$ is reversed and is −1.0 volts. Because the first source/drain region of the second field-effect transistor 424 is at +0.5 volts, $V_n$ may be set to −0.5 volts during a second odd frame. The process can continue in a similar fashion. Therefore, charge carriers become trapped within the gate dielectric layer of a field-effect transistor during one time period, and a substantial fraction of the charge carriers are de-trapped from the gate dielectric layer of that field-effect transistor during a subsequent time period.

In another embodiment, the output inverters in FIG. 12 may be used. During the first odd frame (e.g., first time period), $V_{data}$ and $V_{control1}$ are +1.0 volts. The inverter can invert $V_{data}$ and cause $V_{control2}$ to be −1.0 volts during the first odd frame. During the first even frame (e.g., second time period), $V_{data}$ and $V_{control2}$ are +1.5 volts. The inverter can invert $V_{data}$ and cause $V_{control1}$ to be −1.5 volts during the first even frame. The process can continue in a similar fashion.

As previously described, the threshold voltage of a field-effect transistor can be changed as the amount of trapped charge within a gate dielectric layer of the field-effect transistor changes. The accumulation of charge carriers within the gate dielectric layer is substantially proportional to the product of the electrical field across the gate dielectric layer and the time such electrical field is applied. Therefore, voltage-time products can be useful in determining how much de-trapping should be performed based on (1) a voltage or voltage differential that is to be applied for a predetermined time period or (2) the length of time at which a voltage or voltage differential is to be applied. Some of the embodiments previously described use time periods of equal length; however, in another embodiment, different lengths of time periods can be used.

Over a relatively long period of time (e.g., several frames), the cumulative trapped charge within the gate dielectric layer should be relatively low. In still another embodiment, the voltage-time product for any particular frame (e.g., particular time period) does not have to equal the voltage-time product of an immediately preceding frame (e.g., immediately preceding time period). Therefore, an averaged voltage (e.g., time-weighted average) on the gate electrode during radiation emission for any one or more electronic components may be used for determining a value for the voltage applied during de-trapping operations.

In one embodiment, one or more tables can be used for storing entries related to the normal operating mode (e.g., as a display), threshold voltage recovery mode, or both. The table can be as simple as a set of capacitors, or may include a set of memory cells (dynamic random access memory, static random access memory, non-volatile memory), a portion of a hard drive, microcontroller, processor or any combination thereof. In one embodiment, a conventional integrator can be used to determine the voltage-time products during the time periods. Other methods may be used for determining voltage-time products like using a microcontroller or processor.

The entries can include any one or more of the following: $V_{data}$, $V_n$, $V_{GFS/D1}$, $V_{GFS/D2}$, voltage differentials between $V_{data}$ and $V_{ss}$, length of odd frames, lengths of even frames, lengths of any other time period, etc., voltage-time products for normal operating modes, voltage-time products for threshold voltage recovery modes, accumulated voltage-time products for a plurality of time periods for normal operating modes, accumulated voltage-time products for a plurality of time periods for threshold voltage recovery modes, differentials between voltage-time products for normal operating modes and threshold voltage recovery modes, accumulated differentials between voltage-time products for normal operating modes and threshold voltage recovery modes, or the like. Each tuple within the table may correspond to individual radiation-emitting or radiation-responsive electronic components, such as electronic component 108, individual pixels, rows or columns of pixels, portions of a display or sensor array, or the like. Therefore, the table may include information for any part or all of the array. After reading this specification, skilled artisans will be able to design and use tables in a wide variety of manners, and select the design that meets the user's needs or desires.

In one specific embodiment using a table, the method can include collecting first data regarding signals (e.g., $V_{data}$) sent to the gate electrode of the first field-effect transistor 422 during one of the odd frames. The method can include accessing a length of such odd frame and determining a first voltage-time product, wherein the first time-voltage product is the length of the odd frame (first time period) times a first voltage difference for the first field-effect transistors 422. The first voltage difference for the first field-effect transistor 422 is a voltage on the gate electrode of the first field-effect transistor 422 minus a voltage on the first source/drain region of the first field-effect transistor 422 or the second source/drain region of the first field-effect transistor 422. The first voltage-time product can be stored within the table. The method can further include accessing the first voltage-time product and a length of the second time period from the table. A second value of a second signal can be determined by multiplying the first voltage-time product times −1 to give a second voltage-time product, dividing the second voltage-time product by the length of the second time period to obtain a quotient, and adding the quotient to a reference voltage (e.g., $V_{ss}$) to obtain the value of the second signal. This same procedure can be repeated for other electronic components similar to electronic component 108.

5. Other Embodiments

The embodiments described above are well suited for AMOLED displays. Still, the concepts described herein can be used for other types of radiation-emitting electronic components. Other radiation-emitting electronic components can include lighting panels, inorganic LEDs, including III-V or III-VI-based inorganic radiation-emitting components. In one embodiment, the radiation-emitting electronic components may emit radiation within the visible light spectrum, and in another embodiment, the radiation-emitting electronic component may emit radiation outside the visible light spectrum (e.g., UV or IR).

In another embodiment, the concepts described herein may be extended to other types of electronic devices. In one embodiment, a sensor array may include an array of radiation-responsive electronic components. In one embodiment, different radiation-responsive electronic components may have the same or different active materials. The response of those active materials may change over time. Further, the sensor array may have different portions that receive different wavelengths, different radiation intensities, or a combination thereof. The embodiments described herein can be used to allow the radiation-responsive electronic components to be on substantially all the time (during different frames or time periods), while at least one conduction path is on and at least one other conduction path is off. Similar to an electronic device with radiation-emitting electronic components, the lifetime of an electronic device with radiation-responsive electronic components may have a longer useful life.

6. Advantages

Embodiments described herein have benefits compared to conventional devices. For example, several methods are provided that are able to recover and reverse the drift of the threshold voltage automatically. As such, thin-film field effect transistors that are processed at relatively low temperatures and relatively low costs can be used for AMOLEDs. Moreover, the recovery methods provided above allow the thin-film field effect transistors to operate with a relatively high stability. The methods described above are useful for increasing the operating lives of AM backpanels made with a-Si and with LTPS. Further, these methods can increase the operating lives of AM backpanels formed on plastic substrates and flexible metal foils. Also, these methods can increase the operating lives of AM backpanels made with inorganic semiconductor compounds (e.g., CdTe, CdSe, CdZnTe, ZnSe, ZnTe, etc.), and organic semiconductor materials. In general, the present methods are useful for increasing the operating lives of thin film field effect transistors having dielectric insulators layers processed at relatively low temperatures, e.g., below 400° C.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense and all such modifications are intended to be included within the scope of the invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

What is claimed is:

1. A method of operating an electronic device comprising a first electronic component, wherein the first electronic component is a radiation-emitting electronic component or a radiation-responsive electronic component, and wherein a first terminal of the first electronic component is connected to first terminals of at least two parallel conduction paths within a driving unit, including a first conduction path and a second conduction path, the first conduction path including a first field effect transistor comprising a gate electrode, a first source/drain region, and a second source drain region, wherein the method comprises:

during a first time period, activating the first conduction path within the driving unit so that current flows through the first conduction path and the first electronic component while the second conduction path of the driving unit is off;

determining a first voltage-time product, wherein for the first field-effect transistor:

the first voltage-time product is the length of the first time period times a first voltage difference for the first field-effect transistor;

the first voltage difference for the first field-effect transistor is a voltage on the gate electrode of the first field-effect transistor minus a voltage on the first source/drain region of the first field-effect transistor, the second source/drain region of the first field-effect transistor, or both;

accessing a length of a second time period; and during the second time period, activating the second conduction path within the driving unit so that current flows through the second conduction path and the first electronic component while the first conduction path of the driving unit is off.

2. The method of claim 1, wherein:

if the first electronic component is a radiation-emitting electronic component, the first electronic component emits radiation during the first and second time periods; and if the first electronic component is a radiation-responsive electronic component, the first electronic component responds to radiation during the first and second time periods.

3. The method of claim 1, wherein:

the first and second source/drain regions of the first field-effect transistor are connected to the first conduction path;

the second conduction path comprises a second field-effect transistor comprising a first source/drain region, a second source/drain region, a gate electrode, and a gate dielectric layer; and the first and second source/drain regions of the second field-effect transistor are connected to the second conduction path.

4. The method of claim 3, wherein:

the first source/drain regions of the first and second field-effect transistors are connected to each other; and the second source/drain regions of the first and second field-effect transistors are connected to each other.

5. The method of claim 3, wherein each of the first and second field-effect transistors comprises a channel region, wherein the channel region is formed as amorphous silicon (a-Si), low-temperature polysilicon (LTPS), continuous grain silicon (CGS), or any combination thereof.

6. The method of claim 5, wherein the first electronic component is an organic electronic device.

7. The method of claim 5, wherein the electronic device further comprises:

a first data holder unit comprising a first terminal and a second terminal, wherein the first terminal of the first data holder unit is coupled to the second source/drain region of the first field-effect transistor, and the second terminal of the first data holder unit is connected to the gate electrode of the first field-effect transistor; and a second data holder unit comprising a first terminal and a second terminal, wherein the first terminal of the second data holder unit is coupled to the second source/drain region of the second field-effect transistor, and the second terminal of the second data holder unit is connected to the gate electrode of the second field-effect transistor.

8. The method of claim 7, wherein:

during the first time period, the first data holder unit holds a first signal corresponding to a first image, and the second data holder unit holds a second signal corresponding to a first threshold voltage recovery signal; and during the second time period, the first data holder unit holds a third signal corresponding to a second threshold voltage recovery signal, and the second data holder unit holds a fourth signal corresponding to a second image.

9. A method of operating an electronic device comprising an array of first electronic components, wherein:

each of the first electronic components is a radiation-emitting electronic component or a radiation-responsive electronic component;

for each first electronic component, a first terminal of the first electronic component is connected to first terminals of at least two parallel conduction paths within a driving unit, including a first conduction pat and a second conduction path;

the first conduction path comprises a first field-effect transistor comprising a first source/drain region, a second source/drain region, and a gate electrode, wherein the first and second source/drain regions of the first field-effect transistor are connected to the first conduction path;

the second conduction path comprises a second field-effect transistor comprising a first source/drain region, a second source/drain region, and a gate electrode, wherein the first and second source/drain regions of the second field-effect transistor are connected to the second conduction path;

wherein the method comprises:

collecting first data regarding first signals sent to the gate electrodes of the first field-effect transistors during a first time period, wherein the first signals correspond to a first image;

accessing a length of the first time period;

determining first voltage-time products, wherein for each first field-effect transistor:

each of the first voltage-time products is the length of the first time period times a first voltage difference for one of the first field-effect transistors; and the first voltage difference far the each first field-effect transistor is a voltage on the gate electrode of the first field-effect transistor minus a voltage on the first source/drain region of the first field-effect transistor, the second source/drain region of the first field-effect transistor, or both;

accessing a length of a second time period; and determining second values of second signals that are to be sent to the gate electrodes of the first field-effect transistors during the second time period, wherein the second signals correspond to first threshold voltage recovery signals.

10. The method of claim 9, wherein the first signals have an opposite polarity compared to the second signals, wherein a reference voltage for determining polarity is a reference voltage representative of voltages of the first source/drain regions of the first field-effect transistors or the second source/drain regions of the first field-effect transistors during the first time period.

11. The method of claim 9, wherein determining the second values of the second signals comprises:

multiplying the first voltage-time products times −1 to give second voltage-time products;

dividing the second voltage-time products by the length of the second time period to obtain quotients; and adding the quotients to a reference voltage to obtain the values of the second signals.

12. The method of claim 9, wherein each of the first and second field-effect transistors comprises a channel region, wherein the channel region is formed as amorphous silicon (a-Si), low-temperature polysilicon (LTPS), continuous grain silicon (CGS), or any combination thereof.

13. The method of claim 12, wherein the electronic device comprises a driving unit comprising the first and second field-effect transistors, wherein the driving unit further comprises:

a first data holder unit comprising a first terminal and a second terminal, wherein:

the first field-effect transistor further comprises a gate dielectric layer;

the first terminal of the first data holder unit is connected to the gate electrode of the first field-effect transistor; and the second terminal of the first data holder unit is coupled to the second source/drain region of the first field-effect transistor; and a second data holder unit comprising a first terminal and a second terminal, wherein:

the second field-effect transistor further comprises a gate dielectric layer;

the first terminal of the second data holder unit is connected to the gate electrode of the second field-effect transistor; and the second terminal of the second data holder unit is coupled to the second source/drain region of the second field-effect transistor.

14. The method of claim 9, wherein each first electronic component comprises an organic electronic device comprising an organic active layer.

15. The method of claim 14, wherein the first electronic components are radiation-emitting electronic components.

* * * * *